US008459458B2

(12) United States Patent
Wagner et al.

(10) Patent No.: US 8,459,458 B2
(45) Date of Patent: Jun. 11, 2013

(54) DISPOSABLE RIGID CONTAINER FOR PHARMACEUTICAL COMPOSITIONS

(75) Inventors: John Wagner, Værløse (DK); Flemming Wagner, Frederiksberg (DK)

(73) Assignee: MedComb Holding ApS, Copenhagen V (DK)

( * ) Notice: Subject to any disclaimer, the term of this patent is extended or adjusted under 35 U.S.C. 154(b) by 0 days.

(21) Appl. No.: 13/634,822

(22) PCT Filed: Mar. 18, 2011

(86) PCT No.: PCT/DK2011/050087

§ 371 (c)(1), (2), (4) Date: Nov. 5, 2012

(87) PCT Pub. No.: WO2011/113439

PCT Pub. Date: Sep. 22, 2011

(65) Prior Publication Data

US 2013/0056386 A1 Mar. 7, 2013

Related U.S. Application Data

(60) Provisional application No. 61/315,258, filed on Mar. 18, 2010, provisional application No. 61/315,273, filed on Mar. 18, 2010.

(30) Foreign Application Priority Data

Mar. 18, 2010 (DK) ..... 2010 70107
Mar. 18, 2010 (DK) ..... 2010 70108

(51) Int. Cl.
*B65D 83/04* (2006.01)

(52) U.S. Cl.
USPC ..... 206/532; 206/538; 53/452

(58) Field of Classification Search
USPC ..... 206/528, 531, 532, 534, 534.1, 534.2, 206/538; 53/452, 453, 456, 476, 477, 478, 53/467, 397
See application file for complete search history.

(56) References Cited

U.S. PATENT DOCUMENTS

| | | | | |
|---|---|---|---|---|
| 3,809,220 | A | 5/1974 | Arcudi | |
| 3,809,221 | A | 5/1974 | Compere | |
| 3,835,995 | A | 9/1974 | Haines | |
| 3,924,748 | A | 12/1975 | Braverman | |
| 4,254,871 | A | 3/1981 | Poore | |
| 4,429,792 | A * | 2/1984 | Machbitz | 206/531 |
| 4,627,432 | A | 12/1986 | Newell et al. | |
| 4,850,489 | A | 7/1989 | Weithmann et al. | |
| 4,889,238 | A | 12/1989 | Batchelor | |

(Continued)

FOREIGN PATENT DOCUMENTS

| | | |
|---|---|---|
| EP | 1040051 B1 | 3/2003 |
| EP | 1462384 A1 | 9/2004 |

(Continued)

*Primary Examiner* — Jacob K Ackun
(74) *Attorney, Agent, or Firm* — Knobbe Martens Olson & Bear LLP

(57) ABSTRACT

A disposable rigid package containing pharmaceutical compositions which protects tablets, capsules, soft shell pills against hard transporting conditions and undesired rupture. The package allows for personal transportation, e.g. in a pocket, and it is easy and convenient to open for people of all level of ability and dexterity. Its design allows for transport as standard mail withstanding temperature fluctuation, vibrations and shocks, mechanical pressure and variation in atmospheric pressure which may occur during transport.

20 Claims, 35 Drawing Sheets

U.S. PATENT DOCUMENTS

| | | | | |
|---|---|---|---|---|
| 5,240,113 | A | 8/1993 | Gibilisco | |
| 5,358,118 | A | 10/1994 | Thompson et al. | |
| 5,381,904 | A | 1/1995 | Thurell | |
| 5,788,079 | A | 8/1998 | Bouthiette | |
| 5,909,822 | A | 6/1999 | George et al. | |
| 6,375,956 | B1 | 4/2002 | Hermelin et al. | |
| 7,866,476 | B2 * | 1/2011 | McGonagle et al. | 206/535 |
| 2001/0030140 | A1 | 10/2001 | Mundt | |
| 2002/0162769 | A1 | 11/2002 | Weinstein | |
| 2003/0098257 | A1 | 5/2003 | Robertson | |
| 2003/0102247 | A1 | 6/2003 | Inoue et al. | |
| 2004/0093835 | A1 * | 5/2004 | Siegel et al. | 53/452 |
| 2004/0266745 | A1 | 12/2004 | Schwanitz et al. | |
| 2005/0077203 | A1 | 4/2005 | Morita et al. | |
| 2005/0084700 | A1 | 4/2005 | Ede et al. | |
| 2006/0289328 | A1 | 12/2006 | Hession | |
| 2007/0015728 | A1 | 1/2007 | Ford | |
| 2007/0015839 | A1 | 1/2007 | Folli et al. | |
| 2007/0187273 | A1 | 8/2007 | Grosskopf | |
| 2008/0067099 | A1 * | 3/2008 | Young | 206/532 |
| 2009/0139893 | A1 | 6/2009 | McGonagle et al. | |
| 2012/0228185 | A1 * | 9/2012 | Ludwig et al. | 206/532 |

FOREIGN PATENT DOCUMENTS

| | | | |
|---|---|---|---|
| EP | 1502568 | A1 | 2/2005 |
| WO | WO 98/22072 | | 5/1998 |
| WO | WO 03/079959 | A1 | 10/2003 |
| WO | WO 03/089333 | A1 | 10/2003 |
| WO | WO 2004/031050 | A1 | 4/2004 |
| WO | WO 2004/089274 | A1 | 10/2004 |
| WO | WO 2004/103255 | A2 | 12/2004 |
| WO | WO 2005/120984 | A1 | 12/2005 |
| WO | WO 2006/057600 | A1 | 6/2006 |
| WO | WO 2007/067054 | A1 | 6/2007 |
| WO | WO 2007/072494 | A1 | 6/2007 |
| WO | WO 2008/014862 | A1 | 2/2008 |
| WO | WO 2008/104765 | A1 | 9/2008 |

* cited by examiner

DISPOSABLE RIGID CONTAINER FOR PHARMACEUTICAL COMPOSITIONS

CROSS REFERENCE TO RELATED APPLICATIONS

This application is a U.S. National Phase Application of PCT International Application Number PCT/DK2011/050087, filed on Mar. 18, 2011, designating the United States of America and published in the English language, which is an International Application of and claims the benefit of priority to U.S. Provisional Application No. 61/315,258, filed on Mar. 18, 2010, Danish Patent Application No. PA 2010 70108, filed on Mar. 18, 2010, U.S. Provisional Application No. 61/315,273, filed on Mar. 18, 2010, and Danish Patent Application No. PA 2010 70107, filed on Mar. 18, 2010. The disclosures of the above-referenced applications are hereby expressly incorporated by reference in their entireties.

FIELD OF THE INVENTION

The present invention relates to pharmaceutical compositions containers, in particular to disposable containers for dispensing pills, tablets and capsules.

BACKGROUND OF THE INVENTION

Solid pharmaceutical compositions such as tablets and capsules are often contained for dispensing in blister packages. Generally a blister package comprises a moulded plastic sheet having one or more depressions each defining a blister chamber, typically for containing a tablet or capsule; these depressions are commonly referred to as 'blisters'. This sheet is generally covered by a thin layer of foil for sealing the tablets or capsules within the blisters. Pressing on a blister causes the tablet or capsule contained in that blister to penetrate the foil layer so that it can easily be removed from the package. The blister from which the tablet is removed is left deformed, and the foil is torn in the region below the blister, but the other blisters remain intact. Blister packages are usually further packed in a paper box together with a leaflet containing information about the medication.

This secondary package has the function of holding items securely, avoiding tablets loss from undesired rupture during transportation.

Blister packages are generally transported by air, sea or rail and travel by road for at least part of their journey from the manufacturer to the pharmacy and from the pharmacy to the end user. Further package handling involves dissembling into smaller units of big pallet loads for stacking on shelves in distribution warehouses and then picking off the shelves to assemble mixed product loads the meet the user needs. This means that packages and their content are subjected to vibrations and shocks, temperature fluctuations, mechanical pressure, humidity changes and variation in atmospheric pressure. These fluctuations can lead to seal failure, cracking of blisters, scuffing of labels and decorated surfaces. Packages may also experience reduced atmospheric pressure and temperature fluctuation during distribution, which may lead to deterioration of the properties of the material of the package leading to undesired ruptures.

Despite these fluctuations packages still need to meet several criteria like: i) if sterility is needed, it must be maintained for the duration of the specified shelf life; ii) normal distribution hazards must be tolerated without product or package damage; iii) the pharmaceutical composition must tolerate physical contact with the package without adverse reactions; iv) packages must tolerate the climatic conditions; v) the package surface must be of suitable material to accept labelling and/or printing and have sufficient area; vi) comply with national regulations.

In order to protect a blister package and its content during transportation several approaches have been used.

One known approach provides a solution to the aforementioned problem by using external "boxes" to contain the blister packages, e.g. typically used with blister packages containing oral contraceptives.

For example, WO 07072494 describes a multi-layer thermoformed, translucent pharmaceutical packaging blister container consisting of poly vinyl chloride (PVC), which can be metalized so as to achieve a degree of opacity.

US 2003/098257 describes a credit card-sized carrier for a medication. The carrier is composed of a lower housing having a cavity which houses a medicament wafer. A cover is removably attached to the lower housing to enclose the cavity.

WO 08104765 relates to a container suitable for use in packaging pharmaceutical products such as tablets and capsules. The container can be withdrawn from a box or sleeve to a fully extended position whereby a user can remove any item stored by the container.

In some other approaches an external carrier is used, where for external carrier is meant an external packaging, mainly hard paper or cardboard, which can house a variety of blister packages.

For example, US 2007/0187273 discloses a packaging container for displaying and housing products. The packaging container may include tear-resistant housing that encloses an opaque tray made from a paper material. An insert card may be used within the housing to reinforce the container so as to obtain a clamshell package.

US 2005/0077203 relates to a press through blister package (PTP) case with h one or more pills therein. The PTP case includes foldable members to accommodate the blisters.

US 2006/289328 describes a foldable package including a blank having a face panel and a back panel, where a blister pack is sealed between them. In this way the blisters are aligned over gates and protrude through apertures and tabs and form a composite pull tab. To remove an item from a blister, the pull tab is pressed out of the panels, the tab strip is peeled from the back panel, and pressure is applied to force the item through the backing sheet of the blister pack and the exposed gate.

WO08014862A relates to a packaging for solid pharmaceutical forms which is further packed into a secondary container to improve its protection.

In same other approaches solid dispensers for containing and dispensing pills have been used.

For example, U.S. Pat. No. 5,788,079 describes a pill sorting container which is characterized by three layers: i) a recessed support made of rigid plastic material with cavities therein, ii) a container defining sheet made of plastic, designed to fit into the support for containing the pills, and iii) a container sealing sheet made of self-adhesive paper.

U.S. Pat. No. 5,381,904 discloses a dispenser for medical preparations including a rectangular box which accommodates an insert for containing a series of compartments for receiving the medical preparations. The dispenser is opened by shutters which can slide.

US 2005/0084700 describes a pharmaceutical compositions container characterized by a solid carrier, which can be made of plastic, having cavities where cup-shaped inserts can be formed with a mould material. These inserts may be designed freely so as to fit the pharmaceutical compositions, e.g. tablets, to be contained.

An alternative solution to the problem is described by US 2003/102247 where blister packages are winded around each other into a container.

The above discussed holders, dispensers and pharmaceutical packages are deficient in several aspects. Significantly, none of the above references present a convenient, simple and effective way of protecting a blister packaging for medical use and its content from undesired rupture during transportation and handling, e.g. boxes protecting medical packaging can generally not withstand pressure strain from mail delivering. Withstand pressure strain from mail delivering is a requirement that has been rising in particular in recent times, because of the development of online pharmacy system, where patients can order medicine on line and get them delivered to their addresses. Further, none of the above references specifically addresses a way to facilitate the opening of a blister package where these conditions of safety are present. Therefore, there remains a need for a simple, inexpensive and convenient means for providing a disposable container for pharmaceutical compositions which is easy to open and has a high degree of safety against undesired rupture and pressure.

Hence, an improved container for pharmaceutical compositions would be advantageous, and in particular an improved disposable container for pharmaceutical compositions which could be able to protect the contained pharmaceutical compositions during transportation in hard conditions, e.g. sent by normal mail, would be advantageous.

OBJECT OF THE INVENTION

It is an object of the invention to provide a disposable container for pharmaceutical compositions where the pharmaceutical compositions contained are protected against undesired rupture of the package while opening of the package is still easy and convenient for people of all level of ability and dexterity.

It is also an object of the invention to provide a disposable container for pharmaceutical compositions in the form of soft shell pills.

It is a further object of the present invention to provide an alternative to the prior art for personal transportation of a disposable container for pharmaceutical compositions which allows to be personally carried and transported, e.g. in a pocket, and at the same time provide a good protection against undesired rupture of the package.

In particular, it may be seen as an object of the present invention to provide a container for a pharmaceutical compositions that solves the above mentioned problems of the prior art with the use of a rigid structure.

SUMMARY OF THE INVENTION

The present invention relates in particular to a disposable pharmaceutical compositions container for dispensing pills, tablets and capsules comprising a rigid structure of material having cavities on its surface to surround and protect the pharmaceutical compositions herein contained.

Disposable is herein defined as designed to be disposed of after use, so that it may be disposed of after one use. In particular disposable is herein defined as adapted to be used only once, i.e. single use, meaning that further use of the package after the removal of the cover sheet in not feasible, e.g. the cover sheet cannot be re-attached to the carrier after being removed.

For the purpose of this application disposable is also referred herein as single use.

Thus, the above described object and several other objects are intended to be obtained in a first aspect of the invention by providing a single use medical package comprising a carrier with at least one cavity for housing pharmaceutical compositions on at least one of the carrier surfaces and at least one cover sheet, wherein the carrier comprises a rigid structure, wherein the rigid structure is or comprises an internal hollow structure, wherein the internal hollow structure is at least partially hollow between the top and the bottom surface of the carrier.

The single use medical package according to one embodiment of the invention is characterized by a carrier which is a robust and rigid structure with cavities for housing, e.g. pharmaceutical compositions. The invention has several advantages. The rigid structure allows for safety in transportation and for protection of pharmaceutical composition during transportation avoiding undesired ruptures even in harsh conditions of transport. For example, the disposable package of the present invention could be sent and delivered by standard postal mail without the needs of further external packaging for protection; providing therefore a better protection and reducing packaging volumes and environmental costs, e.g. of more than 50%, due to reduction of packaging material needed and package disposure. In that respect it is an advantage of the present invention that the size and dimensions of the disposable package are so that the package can be delivered directly in a standard mail box.

A further advantage of the invention is that the package allows for transport of pharmaceutical compositions in the form of soft shells tablets. Generally, soft shells tablets are not easy to be transported as their soft shell or coating is more sensitive towards vibrations and pressure shocks. To allow transportation and handling of soft shells tablets, reinforcements are generally provided in the form of extra coating layers onto the tablets. This renders soft shells tables easier to be handable. The present invention allows for transport of soft shells tablets protecting them from mechanical degradation and avoiding the need of further tablets treatments. Furthermore, soft shell tablets can be accessed avoiding undesired degradation and potential destruction which is generally caused by using push-through opening system, as the access to the tablets is gained in the invention by using a pull-off or tear-off opening system.

A rigid structure is herein defined as a structure with the characteristic of being firm, having a certain degree of stiffness, unbendability and inflexibility so as to allow for safe handling in transportation through normal post avoiding undesired rupture.

In some embodiments the rigid structure is or comprises an internal hollow structure. In some embodiments the rigid hollow structure may be internally filled with air or other gases, e.g. inert gases.

In other embodiments the rigid structure is a solid block of material, e.g. the structure in between the cavities is not hollow.

The material constituting the carrier comprising the rigid structure with the function of pharmaceutical composition container may be plastic, plastic laminates, plastic/paper laminates or plastic/metal foil laminates or metal. Non-limiting exemplary suitable plastics for the carrier are laminates containing PVC, polyamides, polyolefins, polyesters, polycarbonates, teflon and combinations thereof. The carrier may also feature a barrier layer against gases, vapours and light. Such barrier may be comprised in the material constituting the carrier or may be added as supplementary layers for example as a metal foil such as an aluminium foil embedded in a plastic laminate or ceramic layers or metallic layers embedded between two plastic layers. Ceramic layers may be produced by evaporating metals, oxides or nitrides of aluminium, silicon and other metals and semimetals in vacuum and depositing the substances on a plastic substrate. The ceramic layers may be preferably contain aluminium oxides or silicon oxides or may be mixtures of various oxides, if desired also mixed with metals such as silicon or aluminium. Metal layers may be created by evaporating metals in vacuum and depositing the metals on a plastic substrate; aluminium layers may be mentioned here by way of example. The plastic substrate may be a plastic film or a plastic base made of the above mentioned plastics.

In some embodiments the rigid structure is or comprises a block of material.

A block is herein defined as a hard and solid piece of material.

The cavities may have different forms and shapes such us cups or dishes, without limitation. The cavities may be surrounded by a shoulder, said shoulders together forming an interconnected flat plane.

In some embodiments the cavities may be engraved, such as etched, carved out through mechanical, thermal or pressure based treatments in the rigid structure, e.g. in the block of material.

In some other embodiments the cavities in the rigid structure may be obtained by calendering, casting, injection molding or other know thermoplastic processes leading the formation of the rigid structure of plastic material by imposing a shaping surface to its molten. In this case the cavities are produced by shaping the rigid structure when the plastic material is, at least partially in its melted state.

The cover sheet material may be an aluminium foil or a laminate containing aluminium foil. The aluminium foil may be replaced by a plastic foil. The aluminium foil may be also replaced by a plastic that exhibits low elasticity and poor stretching properties. A plastic material having these properties may be obtained when large amounts of filler materials are added to the plastic.

Filler is herein defined as particles of a material which is added to plastic material to provide properties which are different in respect to the one of the plastic alone. In some other embodiments the cover sheet may be also made of plastic, plastic laminates, plastic/paper laminates or plastic/metal foil laminates, metal foils.

The cover sheet covers at least partially the recessed carrier and, for example, by sealing or adhesive bonding is jointed to the carrier. In some embodiments the cavities of the carrier may be surrounded by a shoulder, said shoulders together forming an interconnected flat plane. In these embodiments the cover sheet is jointed to the carrier by sealing or adhesive bonding at the shoulders. The cover sheets may be sealed or adhesively bonded to the shoulders over the whole area or, by choosing a special sealing tool or bonding pattern for the purpose, this sealing or bonding may be only partial.

The cover sheet may also feature a barrier layer against gases, vapours and light. Such barrier may be comprised in the material constituting the cover sheet or may be added as supplementary layers as described previously in relation to the carrier.

The access to the cavities of the carrier is obtained by removal of the cover sheet.

In some other embodiments, the access to the cavities is achieved by removal of the at least one cover sheet.

In some embodiments, the removal of the at least one cover sheet is achieved by peeling off the at least one cover sheet.

Removal of the cover sheet may be by peeling off, e.g. tearing off the sheet or by peeling, e.g. tearing off a gripping element connected to the cover sheet such as a tab, a strip, a snip, a notch or a flap. This gripping element has the characteristics of being at least partially not sealed or not strongly sealed to the carrier. It has the function of providing a better grip to the user for peeling off, e.g. tearing off the cover sheet and gain access to the cavities. Form, size and shape of the gripping element are linked to its function. The gripping element may have any form and size which allows for human or mechanical gripping. The gripping element shape may be of any geometrical form or combination of forms, e.g. triangular, circular or square. In some embodiments the gripping elements may have a user friendly shape, e.g. resembling a pad so as to provide a better user hold upon use. In some embodiments the gripping element may be made of non-slippery material, such as rubber or may have a certain degrees of surface roughness so as to provide a better grip. The gripping elements may be placed in different locations along the edges of the cover sheets.

The combination of a peeling-off, e.g. tearing-off the at least one cover sheet and the carrier comprising a rigid structure with or without a helping element facilitates the opening of the package. Generally, medical staff or patients with chronic diseases or people with low level of ability and dexterity have a great deal of frequent opening of medical packaging. When these medical packages employ an opening push through system, frequent users may be affected by causing occasionally wrist medical condition e.g. wrist sprains or finger medical conditions such as finger pain. The problem is rather frequent as shown by the presence on the market of machineries adapted to push-through tablets, pills or capsules reducing strains on users' joints. The invention has the advantage of allowing for an easier opening system as peeling-off, e.g. tearing-off a flexible cover sheet from a rigid package is facilitated by the rigidity of the carrier. Generally when peeling-off or tearing-off of a cover sheet is part of the opening system a users often face the problem that peeling-off or tearing-off flexible layers from a soft and flexible carrier is rather difficult as the carrier may follow the peeling-off movement leading to a not efficient peeling-off.

In some embodiments a system to allow selective access to cavities on the carrier is employed. For example the cover sheet may be interrupted along specific lines determined by the cavities edges. In this way removal the cover sheet may be partial as to provide only access to a single cavity and the pharmaceutical composition herein contained at a time.

In some other embodiments the carrier has at least one cavity for housing pharmaceutical compositions on the top and at least one cavity for housing pharmaceutical compositions on the bottom surface of said carrier, i.e. the cavities are present on the top and on the bottom surface of the carrier. In these embodiments according to one aspect of the invention the disposable package has the advantage of being able to carry double the amount of the pharmaceutical compositions carried by the package having the same dimensions and containing cavities on only one surface of the carrier. This embodiment has also the advantage of using less material for the production of the carrier as less material is needed since the number of cavities is doubled.

In some other embodiments the at least one cavity for housing pharmaceutical compositions on the top and at least one cavity for housing pharmaceutical compositions on the bottom surface of the carrier are located off-set in respect to each other in an intermeshing fashion.

In some further embodiments the carrier comprises at least two pivotally connected halves each comprising at least one cavity for housing pharmaceutical compositions, and wherein the at least two halves are made from one single sheet foldable into a folded configuration thereby producing the rigid structure.

Pivotally is herein defined as connected in a pivotal manner, e.g. by means of or on a pivot so that it can be turned around along a pivot such a specific point, axes or edge, e.g. a fold line as indicated by the figures on the invention.

In some embodiments the at least one cavity on one of said at least two halves of said carrier is located off-set with respect to the at least one cavity on the other of said at least two halves so that the cavities intermesh when the two halves are folded into the folded configuration, so that the cavities may support the opposite carrier surface in the folded configuration, thereby providing rigidity to the package.

In some embodiments, the at least one cover sheet is protected by at least one lid.

Herein lid is defined as a removable film, foil, rigid sheet, panel or a hollow body which protects the cover sheet from undesired rupture.

In some other embodiments the lid may also contain a leaflet with information of interest to the patient, e.g. instructions on how to use the pharmaceutical compositions contained, or commercial for related medicaments.

In some other embodiments these information of interest for the patient may be printed, embossed, carved, stamped or etched on the internal or external surface of the at least one lid.

This embodiment has the advantage of avoiding wrong uptake of medicine and providing correct compliance to therapeutically regimen. Generally leaflets are inserted into external packages separated from the blister package. These leaflets can easily get lost as the external paper package experiences frequent rupture or simply for forgetfulness of the patients. In some cases the blister package is carried alone by the patient without the external package and the instruction leaflet is mostly left with it. The embodiment according to the invention has the advantage that allows for carrying of the leaflets together with the pharmaceutical composition carrier so that it is always possible to check posology of the pharmaceutical composition to be used before uptaking and therefore avoiding mistake in adherence to the therapeutically regimen.

The at least one lid may be made of plastic, plastic laminates, plastic/paper laminates or plastic/metal foil laminates or metal. Non-limiting exemplary suitable plastics for the carrier are laminates containing PVC, polyamides, polyolefins, polyesters, polycarbonates, teflon and combinations thereof. The at least one lid may be also made of material which is at least partially transparent in visible range of light as to allow for visual inspection pharmaceutical composition contained in the cavities of the carrier.

In some embodiments the at least one lid is fully removable. In other embodiments the at least one lid may be opened through a rotation of the lid along at least one rotational joint located on the carrier.

In some other embodiments the at least one lid is or comprise at least one adhesive element, such as a long thin piece of plastic, cloth or paper with binding capabilities, e.g. a piece of tape. In those embodiments access to the cover and carrier can be obtained through a rotation of the lid along one of the edges of the carrier.

In some embodiments the at least one rotational joint may be a hinge. In some embodiments the at least one rotational joint may be a pivot hinge. In some other embodiments the at least one rotational joint may be a pivot hinge with springs means for producing of a counter rotation moment. The presence of a pivot hinge allows for opening of the lid by a lateral rotation movement. In this embodiment closing of the lid is then obtained by the overlay of the lid onto the carrier by the opposite lateral rotation movement.

In some other embodiments the at least one lid is or comprise at least one hollow body, such a sleeve.

In some embodiments the at least one cover sheet may be protected by different lid system, for example access to the at least one cover sheet may be obtained through a slidable windows/shutters system.

In some embodiments the single use medical package comprises at least two cover sheets wherein the carrier has at least two cavities for housing pharmaceutical compositions, the at least two cover sheets are at least partially sealed to the carrier around the at least two cavities for housing pharmaceutical compositions, and the at least two cover sheets overlap and delimit at least one element characterized in that the access to said at least one element is gained by removal of the precedent overlapping cover sheet and that the access to further elements is gained by sequential removal of the respectively precedent overlapping cover sheets.

The single use medical package according to one embodiment of the invention comprises a carrier including at least two cavities covered by separate cover sheets. These cover sheets overlaps in predetermined areas delimiting elements which can be gripped and peeled or torn off by pulling upwards and backwards to provide access to the relative cavity located on the underneath carrier. Removal of the first cover sheet by peeling or tearing off of the cover sheet or of a gripping element connected to it provides access to a first cavity and to an element which in turn can be peeled or torn off to provide access to the second cavity and its content and to a second element and so on. Removal of cover sheets may be obtained in a predetermined and specific sequential way determined by the overlapping of the cover sheets delimiting the elements. This has the advantage of allowing for access to the content of the relative cavity in a desired and predetermined sequential way.

Sequential is defined as occurring in regular succession, while preceding is defined as previous following a specific spatial order, e.g. the top cover sheet precedes the immediate bottom overlapping one. Therefore, the access to the first element is gained by removal of the first cover sheet through a determined action, e.g. pull-off or tear-off, on the cover sheet or of a gripping element connected to it and access to the second element is gained by removal of the second cover sheet through a determined action, e.g. pull-off or tear-off, of the first element and so on.

The element at least partially delimited by the overlapping of the cover sheets may take the form of a tab, a strip, a snip, a notch or a flap. The element has the characteristics of being at least partially not sealed or not strongly sealed to the carrier. It has the function of providing a better grip to the user for peeling off or tearing off the cover sheet and gain access to the cavity. Form, size and shape are referred above in the summary of the invention for the gripping elements Day and time indicia, which may be also identified by a colour code, may also be incorporated into the disposable package of the present invention.

In some other embodiments the access to the cavities on the carrier may be obtained by other opening system, e.g. bend and peel off or tear and peel off of the cover sheet.

A pharmaceutical composition herein referred may comprise any biologically-active substance, without limitation. Preferably, the dosage units of the present invention comprise vitamin A, B vitamins, vitamin C, vitamin D, vitamin E, vitamin K, essential fatty acids, folic acid, iron, calcium, magnesium, potassium, copper, chromium, zinc, molybdenum, iodine, boron, selenium, manganese, derivatives thereof or combinations thereof. Non-limiting exemplary biologically-active substances of the present inventive subject matter may include thiamine, thiamine pyrophosphate, riboflavin, flavine mononucleotide, flavine adenine dinucleotide, niacin, nicotinic acid, nicotinamide, niacinamide, nicotinamide adenine dinucleotide, tryptophan, biotin, pantothenic acid, ascorbic acid, retinol, retinal, retinoic acid, beta-carotene, 1,25-dihydroxycholecalciferol, 7-dehyrdocholesterol, alpha-tocopherol, tocopherol, tocotrienol, menadione, menaquinone, phylloquinone, naphthoquinone, calcium, calcium carbonate, calcium sulfate, calcium oxide, calcium hydroxide, calcium apatite, calcium citrate-malate, calcium gluconate, calcium lactate, calcium phosphate, calcium levulinate, phosphorus, potassium, sulfur, sodium, docusate sodium, chloride, magnesium, magnesium stearate, magnesium carbonate, magnesium oxide, magnesium hydroxide, magnesium sulfate, copper, iodine, zinc, chromium, molybdenum, carbonyl iron, ferrous fumarate, polysaccharide iron, and combinations and derivatives thereof, without limitation. Non-limiting exemplary derivatives of vitamin compounds include salts, alkaline salts, esters and chelates of any vitamin compound.

Pharmaceutical composition may be prescription or non-prescription substances or excipients for use in prescription or non-prescription substances. Non-limiting exemplary prescription substances include 13 C-urea (Helicobacter test), 15-Methyl-prostaglandin F2α, 1α-Hydroxyvitamin D3, 2,4-dichlorbenzylalkohol, 5-aminolevulinic acid hydrochloride, 5-aminolevulinsyre (5-ALA), abacavir, abacavir/lamivudine, abacavir/lamivudine/zidovudine, abatacept, abciximab, acamprosat, acarbose, acebutolol, acepromazin, acetaminofene, acetate, acetazolamide, acetophenazine, acetylcysteine, acetylsalicylic acid, aciclovir, acipimox, acitretin, acrivastin, acyclovir, adalimumab, adapalen, adefovir dipivoxil, adenosin, adrenalin, aesculin, agalsidase alfa, agalsidase beta, agalsidase-alfa, agalsidase-beta, agomelatin, agomelatine, alanin, albumin, humant, aldesleukin, alemtuzumab, alendronat, alendronate sodium/colecalciferol, alendronic acid/colecalciferol, alfacalcidol, alfentanil, alfuzosin, alginsyre, alglucosidase alfa, alimemazine, aliskiren, aliskiren hemifumarate/hydrochlorothiazide, alitretinoin, allopurinol, almitrin, almotriptan, alprazolam, alprenolol, alprostadil, alteplase, aluminiumaminoacetat, aluminiumhydroxid, aluminiumsaccharosesulfat, alkalic, amantadine, ambenon, ambrisentan, ambroxol, amfepramon, amidotrizoat, amiloride, aminofyllin, aminogluthetimid, aminosalyl, amiodaron, amisulprid, amitriptylin, amlodipin, amlodipine besylate/valsartan/hydrochlorothiazide, amlodipine besylate/valsartan, amlodipine/valsartan, amorolfin, amoxicillin, amphotericin B, ampicillin, amprenavir, amsachrin, amylase, amylmetacresol, anagrelide, anakinra, anastrozol, anidulafungin, antazoline, antithrombin, antithrombin alfa, antithymocytglobulin, apomorphine, apraclonidin, aprepitant, aprotinin, arcitumomab, argatroban, arginin, aripiprazole, arsenic trioxide, articain, ascorbic acid, asparagin, atazanavir, atenolol, atomoxetin, atorvastatin, atosiban, atovaquon, atropine, auranofin, aurothiomalat, aviptadil, azacitidin, azacitidine, azapropazone, azathioprin, azelaic acid, azelastine, azetazolamide, azithromycin, aztreonam, aztreonam C1-esterase-inhibitor, human, bacampicillin, bacillus Calmette Guérin (Danish strain 1331), bacillus Calmette Guérin (strain RIVM derived from strain 1173-P2), baclofen, balsalazid, bambuterol, bariumsulfat, basiliximab, bazedoxifene, becaplermin, bechlomethasone, beclometasondipropionat, benazepril, bendroflumethiaziede, bensatropine, benserazid, bensylpenicillin, benzalkonium chloride, benzene carboxylic acid, benzenmethanol, benzocain, benzoic acid, benzoylperoxid, benzydamin, benzylpenicillin, betacarotene, betahistin, betain, betaine anhydrous, betamethason, betamethason-17-valerat, betamethason-21-acetat, betamethasondipropionat, betamethasonphosphat, betanidine, betaxolol, bevacizumab, bexarotene, bicalutamid, bimatoprost, bimatoprost/timolol, biotin, biperiden, bisachodyl, bisoprololfumarat, bivalirudin, black rubber-mix (PPD-mix), bleomycin, borax, bortezomib, bosentan, botulinum toxin type a, botulinum toxin type B, brimonidin, brimonidintartrat, brinzolamide, brinzolamide/timolol, bromazepam, bromhexine, bromocriptine, brompheniramine, budesonide, bumetanide, bupivacain, buprenorphine, buprenorphine/naloxone, bupropion, buserelin, buspiron, busulfan, butylscopolamin, cabergolin, cadexomer-iodine, caffeine, cain-mix, calcipotriol, calcitirol, calcitonin, calcitonin (salmon), calcium, calciumacetate, calciumcarbonate, calciumchloride, calciumfluoride, calciumfolinate, calciumgluconate, calciumlactogluconate, calciumpolystyrensulfonate, canakinumab, candesartancilexetil, capecitabine, capsaicin, captopril, carbamazepine, carba-mix, carbetocin, carbidopa, carbimazol, carbomer, carbon, active, carboplatin, carboprost, carglumic acid, carmelloseSodium, carmustin, carvedilol, caspofungin, catumaxomab, cefalexin, cefotaxim, cefoxitin, ceftazidim, ceftriaxon, cefuroxim, celecoxib, cephaclor, cephadroxil, cephalexin, cephalotin, cephradin, certolizumab pegol, cetirizin, cetrorelix, cetuximab, chinidine, chlofibrate, chlomethiazol, chlomipramin, chlonazepam, chloprothixene, chloralhydrat, chlorambucil, chloramphenicol, chlordiazepoxid, chlorhexidine, chloride, chloriongonadotropin, chloroquin, chlorpromazine, chlorpropamid, chlorprothixen, chlorthalidon, chlorzoxazon, chlotrimazol, cholecalciferol, vitamin D3, cholinetheophyllinate, choriogonadotropin alfa, choriongonadotropin, humant (hCG), choriongonadotropin-α (hCG), chrome, ciclopirox, ciclopiroxolamin, ciclosporin, cidofovir, cilastatin, cimetidine, cinacalcet, cinchocain, cinetazon, cinnamaldehyd, cinnamylalcohol, cinnarizine, ciprofloxacin, cis (Z)-flupenthixoldecanoat, cisatracurium, cisplatin, citalopram, Cl+Me-isothiazolinon (Kathon CG), cladribin, cladribine, clarithromycin, clavulansyre, clemastin, clemastine, clindamycin, clioquinol, clobazam, clobetasolpropionat, clobetason-17-butyrat, clodronat, clofarabin, clomiphene, clomipramin, clonazepam, clonidine, clopamide, clopidogrel, clotrimazol, cloxacillin, clozapin, cobalt(II), cobber, cobber acetate, codeine, colesevelam, colestipol, colestyramin, colistimethatSodium, corticotropin, cortisone, cyanochobalamine, cyanocobalamin, vitamin B12, cyclandelar, cyclizine, cyclopentolat, cyclophenile, cyclophosphamid, cyproheptadine, cyproteron, cyproteronacetat, cysteamin, cystein, cystin, cytarabin, cytarabine, dabigatran etexilate, dacarbazine, daclizumab, dalteparin, dantron, dapson, daptomycin, darbepoetin alfa, darifenacin, darifenacin, darunavir, dasatinib, daunorubicin, deferasirox, deferiprone, deferoxaminmesilat, degarelix, demeclocycline, depreotide, desfluran, desipramin, desirudin, deslanoside, desloratadine, desloratadine (as sulphate), desmopressin, desogestrel, desoximethason, dexamethason, dexchlorpheniramine, dexibuprofen, dexketoprofen, dexpantenol, dexpanthenol, Vitamin B5, dexrazoxane, dextran 1, dextran 40, dextran 70, dextromethorphan, dextropropoxyphene, diazepam, diazoxide, diboterminalfa, dichlophenamide, diclofenac, diclofenacSodium, dicloxacillin, diculmarole, didanosin, dienogest, digoxine, dihydralazine, dihydroergotamine, dihydrogesteron, dihydrotachysterol, dihydroxyaluminium sodiumcarbonat, dikaliumchlorazepat, diltiazem, dimeglumingadopentetat, dimenhydinate, dimethylaminodiphenylbuten, dimeticon, dimeticon, ferrofumarate, dinitrogenoxid, dinoprost, dinoproston, diosmin, diphenhydramin, diphenolxylate, dipyradamol, diSodiumclodronate, diSodiumetidronate, diSodiumphosphate, disopyramide, disulfiram, dixyrazine, dobutamine, docetaxel, docosahexaenoinsyre (DHA), docusat, dofetilide, domperidon, donepezil, dopamine, doripenem, dornase alfa, dorzolamid, dosulepin, doxapram, doxazosin, doxepin, doxorubicin, doxorubicin hydrochloride, doxycyclin, doxycycline, droperidol, drospirenon, drotrecogin alfa (activated), duloxetine, dutasterid, ebastin, econazol, eculizumab, efalizumab, efavirenz, efavirenz/emtricitabine/tenofovir disoproxil (as fumarate), eflornithine, eicosapentaenoinsyre (EPA), ekonazol, eletriptan, emedastine, emepron, emtricitabine, emtricitabine/tenofovir disoproxil, enalapril, enfuvirtide, enoxaparin, entacapone, entecavir, ephedrine, epinephrine, epirubicin, eplerenon, epoetin alfa, epoetin beta, epoetin delta, epoetin zeta, epoprostenol, epototermin alfa, epoxyresin, eprosartan, eptacog alfa (activated), eptifibatid, eptifibatide, eptoterminalfa, erdostein, ergocalciferol, vitamin D2, ergotamine, erlotinib, erlotinib, ertapenem, erythromycin, escitalopram, eslicarbazepin, eslicarbazepine acetate, esmolol, esomeprazol, estradiol, estradiolvalerat, estradiolvalerianate, estramustin, estramustinphosphat, estriol, etambutol, etanercept, etanercept, ethacrynacide, ethambutol, ethinylestradiol, ethosuximide, ethylendiamin, ethylmorphine, etidronat, etilephrine, etodolac, etonogestrel, etoposide, etoricoxib, etravirin, etravirine, etulos, eugenol, everolimus, exemestan, exenatid, exenatide, ezetimibe, ezlocillin, factor IX, factor VIII, famciclovir, febuxostat, felodipin, felypressin, fenoterol, fentanyl, fentanyl citrate, ferri-salts, ferritetrasemisodium, ferro-salts, ferrosuccinate, ferumoxsil, fesoterodine, fexofenadin, fibrinogen, fibronektin, filgrastim, finasterid, fiskeolie, flavoxat, flecainide, flucloxacillin, fluconazol, flucytosin, fludarabinphosphat, fludrocortison, fludrocortisonacetat, flumazenil, flumedroxon, flumetasonpivalat, flunarizin, flunitrazepam, fluocinolonacetonid, fluocinonid, fluocortolon 21-pivalat, fluorid, fluormetolon, fluoruracil, fluoxetin, fluoximesteron, flupentizol, fluphenazindecanoat, fluphenazine, flurbiprofen, flutamid, fluticasone furoate, fluticasonpropionat, fluvastatin, fluvoxamin, folic acid, folic acid heparin, follitropin alfa, follitropin beta, follitropin-α (rfSH), follitropin-β (rfSH), fomivirsen, fondaparinux, fondaparinux sodium, formaldehyde, formoterol, fosamprenavir, fosaprepitant, fosaprepitant dimeglumine, fosinoprilSodium, fosphenytoin, framycetin, frangulabark, frovatriptan, fulvestrant, furosemide, fusidic acid, gabapentin, gadobutrol, gadodiamid, gadofosveset, gadoteridol, gadoterinsyre, gadoversetamide, galantamin, galsulfase, ganciclovir, ganirelix, gefitinib, gelatine, gemcitabin, gemeprost, gemfibrozil, gentamicin, geraniol, gestoden, glatirameracetat, glibenclamid, gliclazid, glimepirid, glipizid, glucagon, glucopyrron, glucosamin, glucose, glutamin, glutathion, glycerol, glycerophosphat, glyceryl nitrate, glyceryInitrate, glyceryltrinitrate, glycin, glycopyrron, glycyl-glutamin, glycyl-tyrosin, golimumab, goserelin, gramicidin, granisetron, griseofulvin, guanetidine, guanfacine, haloperidol, heparin, heparin co-factor, heparinoid, hesperidin, hexaminolevulinat, histamine, histidine, histrelin, human coagulation factor IX, human fibrinogen/human thrombin, human normal immunoglobulin, human normal immunoglobulin (IVIg), hydralazine, hydrochloride, hydrochlorthiazide, hydrocortisonacetat, hydrocortisone, hydrocortisone-17-butyrat, hydrocortisonsuccinat, hydrogenperoxid, hydromorphon, hydroxichloroquine, hydroxiprogresterone, hydroxizine, hydroxocobalamin, vitamin B12, hydroxycarbamide, hydroxychloroquin, hydroxycitronellal, hydroxyethylrutosider, hydroxyethylstivelse starch, hydroxyurea, hyoscin, hyoscinbutylbromid, hyoscyamine, hypromellose, ibandronic acid, ibandronsyre, ibritumomab tiuxetan, ibuprofen, icatibant, ichthammol, icodextrin, idarubicin, idursulfase, ifosfamid, iloprost, imatinib, imatinib mesilate, imiglucerase, imipenem, imipramin, imiquimod, immunglobulin G, humant, immunglobulin, humant (anti-D), indapamid, indinavir, indomethacine, infliximab, inositolnico-tinate, insulin, insulin aspart, insulin aspart protamin, insulin detemir, insulin glargine, insulin glulisine, insulin human (rDNA), insulin lispro, insulin lispro protamin, insulin, humant, insulin, isophan, humant, interferon alfa-2b, interferon alfacon-1, interferon beta-1a, interferon idoxuridin, interferon-alfa, interferon-alfa-2b, interferon-beta-1a, interferon-beta-1b, interferon-gamma-1b, interleukin-2, iobitridol, iodidine, iodixanol, ioflupane (123 I), iohexol, iomeprol, iopromid, iotrolan, ioversol, ipratropium, irbesartan, irbesartan/hydrochlorothiazide, irinotecan, isocarboxazid, isoeugenol, isofluran, isoleucin, isoniazid, isophaninsulin, humant, isoprenaline, isosorbiddinitrate, isosorbidmononitrate, isotretinoin, isradipin, itraconazol, ivabradine, ketobemidon, ketobemidone, ketokonazol, Ketoprofen, ketorolac, ketotifen, Kolofon, kreatinin monohydrate, kreatinin monohydrate, labetalol, lacidipin, lacosamide, lactat, lactic acid, lactic acid producing bacteria, lactulose, lamivudine, lamivudine/zidovudine, lamotrigin, lanolin, lanreotid, lansoprazol, lanthanum, lapatinib, laronidase, laropiprant, lasofoxifene, latanoprost, lecithin, leflunomide, lenalidomide, lenograstim, lepirudin, lercanidipin, letrozol, leucin, leucovorin, leuprorelin, levetiracetam, levocabastin, levocetirizin, levodopa, levofloxacin, levofolic acid, levomepromazine, levonorgestrel, levotyroxin, lidocain, lincomycin, linezolid, liotyronin, lipase, liraglutide, lisinopril, lithiumcarbonat, lithiumcitrat, lodoxamid, lofepramin, lomustine, loperamide, lopinavir, loratadin, lorazepam, lormetazepam, lornoxicam, losartan, lovastatin, lutropin alfa, lymecycline, lynestrenol, lypressin, lysine, macrogol 3350, magnesium, magnesium carbonate, magnesium chloride, magnesium hydroxide, magnesiumoxide, magnesiumsulfate, malathion, mangafodipir, mangane, mannitol, maptrotilin, maraviroc, mebendazol, mebeverin, mecasermin, mecillinam, meclozine, medroxiprogresterone, medroxyprogesteronacetate, mefloquine, mefruside, megesterol, megestrolacetat, melatonin, melfalan, meloxicam, melperon, melphalan, memantine, meningokokpolysaccharid, menotropin (hmG), mepensolar, mepivacain, meprobamat, mepyramin, mercaptamine bitartrate, mercaptobenzothiazol, mercapto-mix, mercaptopurin, meropenem, mesalazin, mesna, mesterolon, mestranol, metacycline, metaoxedrin, metenamine, metformin, meth (dopa, methadone, methenamin, methionin, metholazone, methotrexat, methoxy polyethylene glycolepoetin beta, methylaminolevulinat, methyldopa, methylergometrin, methylergotamine, methylnaltrexon, methylnaltrexone bromide, methylperon, methylphenidat, methylprednisolon, methylprednisolonacetat, methylprednisolonsuccinat, methylscopolamine, methyprylon, metixene, metoclopramide, metopimazin, metoprolol, metronidazole, metychlothiazide, mexiletin, mianserin, micafungin, miconazole, midazolam, mifamurtide, miglustat, minoxidil, mirtazapin, misoprostol, mitomycin, mitotane, mitoxantron, mivacurium, moclobemid, modafinil, molybdenum, mometasonfuroat, moroctocog alfa, morphine, moxaverine, moxifloxacin, moxonidin, mupirocin, mycophenoic acid, mycophenolate mofetil, nabumeton, nadolol, nafarelin, nalbuphin, nalidixic acid, naloxone, naltrexon, nandrolon, naphazolin, naproxen, naratriptan, natalizumab, natamycine, nateglinide, nebivolol, nelarabin, nelarabine, nelfinavir, neomycin, neomycinsulfat, neostigmin, nepafenac, nevirapine, nicheritrol, nickel, nicomorphin, nicorandil, nicotin, nicotinamid, nicotinic acid, nicotinic acid/laropiprant, nicotinyl alchol, nifedipine, nilotinib, nimodipin, niphedipin, nitisinone, nitrazepam, nitrendipin, nitric oxide, nitrofurantoin, nitrogen, nitrogen oxide, nitroprusside, nizatidin, nonacog alfa, noradrenalin, norelgestromin, norelgestromin/ethinyl estradiol, norethisteronacetat, noretisterone, norfloxacin, norgestimat, nortriptylin, noscapine, nystatin, oak moss, octocog alfa, octreotid, ofloxacin, olanzapine, olmesartanmedoxomil, olopatadine, olsalazin, omalizumab, omeprazol, ondansetron, opipramol, opium, oral Cholera vaccine, orciprenaline, orlistat, ornidazol, ornithin, orphenadrine, oseltamivir, osteogent protein-1: BMp-7, oxaliplatin, oxazepa, oxazepam, oxcarbazepin, oximetolon, oxiphencyclimine, oxitetracycline, oxprenolol, oxybutynin, oxycodon, oxygen, oxymetazolin, oxytetracyclin, oxytocin, paclitaxel, paclitaxel albumin, palifermin, palifermin, paliperidone, palivizumab, palonosetron, pamidronat, panitumumab, pantoprazole, pantotenol, vitamin B5, pantothenic acid, papaverine, paracetamol, paraffinolie, parathyroid hormone (rDNA), parecoxib, paricalcitol, paroxetin, pegaptanib, pegaptanib sodium, pegfilgrastim, peginterferon alfa-2a, peginterferon alfa-2b, pegvisomant, pegylated interferon-alfa-2a, pegylated interferon-alfa-2b, pemetrexed, penciclovir, penfluridol, penicillamine, pentaeritrityltetranitrate, pentazocine, pentobarbital, pentoxifyllin, pentoxiverine, perflutren, pergolid, periciazin, perindopril, permethrin, perphenazindecanoat, perphenazine, pertussistoksoid, pethidin, pethidine, phenazone, phenazonsalicylat, phenemal, phenfluramin, phenobarbital, phenoperidine, phenoxymethylpenicillin, phenprocoumon, phentanyl, phentolamin, phenylamine, phenylbutazone, phenylephrin, phenylpropanolamine, phenytoine, phosphat, phosphestrol, phytomenadion, vitamin K1, phytominadion, pilocarpin, pimecrolimus, pimozid, pindolol, pioglitazone, pioglitazone/glimepiride, pioglitazone/metformin, pioglitazone/metformin hydrochloride, pipamperon, piperacillin, piritramide, piroxicam, pivampicillin, pivmecillinam, pizitifen, pizotifen, plasminogen, plerixafor, podophyllotoksin, polydocanol, polyestradiolphosphat, polygelin, polymyxin B, polythiazide, posaconazole, potassium, potassium acetate, potassium chloride, potassium dihydrogen phosphate, potassium dikromat, potassium hydroxide, potassium phosphate, p-phenylendiamin, pramipexole, prasugrel, pravastatin, prazosine, prednisolon, prednisolon sodiumphosphate, prednisone, pregabalin, prenalterol, prilocaln, primidone, probanteline, probenecid, procain, procainamide, procarbazine, prochlorperazine, procylidine, proetazine, progesteron, proguanil, prolin, promethazine, propafenon, propanthelinbromid, propionmazine, propofol, proproanolol, propylthiouracil, propyphenazon, proscillaridin, protamin, protein C, protein C, human, protein S, protriptylin, proxiphylline, prucalopride, pseudoephedrine (as sulphate), p-t-butylphenolformaldehyd-resin, pyrazinamid, pyridostigmine, pyridoxin, pyridoxin, Vvtamin B6, pyrityldion, pyrvin, quetiapin, quinagolid, quinapril, quinin, quinolin-mix, rabeprazol, raffinose, raloxifene, raltegravir, ramipril, ranibizumab, ranitidine, ranolazine, rasagiline, rasburicase, reboxetin, recombinant human erythropoietin alfa, remifentanil, repaglinide, reserpine, resorcinol, retapamulin, reteplase, retinol, retinol, vitamin A, ribavirin, riboflavin, vitamin B2, rifabutin, rifampicin, riiterol, rilonacept, riluzole, rimexolon, rimonabant, risedronat, risperidon, ritonavir, rituximab, rivaroxaban, rivastigmine, rizatriptan, rocuronium, romiplostim, ropinirol, ropivacain, rosiglitazone, rosiglitazone/glimepiride, rosiglitazone/metformin, rosuvastatin, rotavirus, rotigotine, roxithromycin, rufinamide, sagradaextract, salazosulfapyridin, salazosulfapyridine, salbutamol, salicylic acid, salicylic amide, salmeterol, samarium [153sm] lexidronam pentasodium, sapropterin, saquinavir, saxagliptin, scopolamine, selegilin, selenium, selenium disulfid, sennaglycosides, serin, sertindol, sertralin, sevelamer, sevelamer (carbonate), sibutramin, sildenafil, simeticon (aktiveret dimeticon), simvastatin, sirolimus, sitagliptin, sitagliptin/metformin hydrochloride, sitagliptin phosphate monohydrate/metformin hydrochloride, sitaxentan, sitaxentan sodium, s-ketamin, sodium oxybate, sodium phenylbutyrate, sodium-chromoglicate, sodiummaurothiomalate auronofin, sodiumpicosulfat, solifenacin, sølvsulfadiazin, somatotropin, somatrem, somatropin, sorafenib, sorbitol, sotalol, spectinomycin, spiramycin, spironolactone, stanozolol, stavudine, stiripentol, streptokinase, strontium ranelate, sucralfat, sufentanil, sugammadex, sulbentin, sulesomab, sulfamethizol, sulfamethoxazol, sulfasalazin, sulfat, sulfisomidine, sulphur hexafluoride, sulpirid, sumatriptan, sunitinib, suxamethon, synstigmine, tacrolimus, tadalafil, tafluprost, tamoxiphene, tamsulosin, tasonermine, taurin, tazobactam, tegafur, teicoplanin, telbivudine, telithromycin, telmisartan, telmisartan/hydrochlorothiazide, temoporfin, temozolomide, temsirolimus, tenecteplase, teniposide, tenofovir disoproxil, tenoxicam, terazosin, terbinafin, terbutalin, teriparatide, terlipressin, terodiline, testosterone, testosteronenantat, testosteronundecanoat, tetanustoksoid, tetrabenazin, tetracosactid, tetracycline, tetryzolin, thalidomide, theophlline, theophyllin og ethylendiamin, thiamazol, thiamin, vitamin B1, thiethylperazine, thioguanine, thiomersal, thiopental, thioridazine, thiotepa, thithixen, threonin, thrombin, human, thyrotropin alfa, tiagabin, tiamazol, tiamin, tiaprofenic acid, tibolon, tigecyclin, tigecycline, timolol, tinidazole, tinzaparin, tiotropium, tipranavir, titandioxide, tizanidin, tobramycin, tocilizumab, tocofersolan, tocopherol, vitamin E, tokoferol, tolazamid, tolbutamid, tolcapone, tolfenamic acid, tolterodin, tolvaptan, topiramat, topotecan, toremifene, trabectedin, tramadol, trandolapril, tranexamic acid, trastuzumab, travoprost, travoprost, travoprost/timolol, treosulfan, treprostinil, triacelluvax, triamcinolonacetonid, triamcinolonhexacetonid, triazolam, trifluoperazine, triglycerid, trimetazidin, trimethaphan, trimethoprim, trimipramin, triptorelin, trombin, tropicamid, tropisetron, trospiumchlorid, tryptophan, tyrotropin, ulipristal, ulipristalacetat, urofollitropin (uFSH), urokinase, ustekinumab, valaciclovir, valdecoxib, valganciclovir, valin, valproat, valsartan, vancomycin, vardenafil, vareniclin, varenicline tartrate, vasopressin, venlafaxin, verapamil, verteporfin, vigabatrin, vildagliptin, vildagliptin/metaformin hydrochloride Idagliptin, vildagliptin/metformin hydrochloride, vinblastin, vinchristin, vindesin, vinflunine ditartrate, vinorelbin, zonisamide, zopiclon, zuclopenthixol, zuclopenthixolacetat, zuclopenthixoldecanoat, zuclopentizol, α1-proteinaseinhibitor (human), α-amylcinnamaldehyd and combinations thereof.

Pharmaceutical composition may be prescription or non-prescription substances such as vaccines. Non-limiting exemplary vaccines can be characterised viable autologous cartilage cells expanded ex vivo expressing specific marker proteins, combined diptheria, tetanus, acellular pertussis and hepatitis B recombinant vaccine, combined hepatitis A and hepatitis B vaccine, diphtheria, tetanus, pertussis, hepatitis B, Haemophilus influenzae type b conjugate vaccine, Diphtheria, tetanus, whole cell pertussis and hepatitis B vaccine, diptheria, tetanus, acellular pertussis, hepatitis B recombinant (adsorbed), inactivated poliomyelitis and absorbed conjugate haemophilus influenzae type b vaccine, diptheria, tetanus, acellular pertussis, hepatitis B recombinant (adsorbed), inactivated poliomyelitis vaccine, haemophilus b conjugate (Meningoccocal Protein conjugate) and hepatitis B (recombinant) vaccine, hepatitis A (inactivated), hepatitis B(rDNA) (HAB) antigen vaccine (adsorbed), hepatitis B (rDNA) vaccine (adjuvanted, adsorbed), hepatitis B (Recombinant) Vaccine, human papillomavirus vaccine, human papillomavirus vaccine [types 6, 11, 16, 18] (recombinant, adsorbed), human rotavirus, live attenuated, Inactivated Hepatitis A virus HBsAg recombinant purified, influenza vaccine (split virion, inactivated), Influenza vaccine (surface antigen, inactivated, prepared in cell culture), Japanese Encephalitis Vaccine (inactivated, adsorbed), measles, mumps and rubella vaccine (live), measles, mumps, rubella and varicella vaccine (live), Pandemic influenza vaccine, Pandemic influenza vaccine (H1N1) (split virion, inactivated, adjuvanted); A/California/7/2009 (H1N1)v like strain (X-179A), Pandemic influenza vaccine (surface antigen, inactivated, adjuvanted); A/California/7/2009 (H1N1)v like strain (X-179A), pandemic influenza vaccine (whole virion, vero cell derived, inactivated) pneumococcal polysaccharide conjugate vaccine (adsorbed), pneumococcal saccharide conjugated vaccine, absorbed, prepandemic influenza vaccine (H5N1) (split virion, inactivated, adjuvanted) A/Vietnam/1194/2004 NIBRG-14, rotavirus vaccine, shingles (herpes zoster) vaccine (live) and combinations thereof.

Non-prescription substances can be a vitamin or derivative thereof, or a mineral compound or derivative thereof. The vitamin or mineral compound may be thiamine, thiamine pyrophosphate, riboflavin, flavine mononucleoride, flavine adenine dinucleotide, niacin, nicotinic acid, nicotinamide, niacinamide, nicotinamide adenine dinucleotide, tryptophan, biotin, folic acid, pantothenic acid, ascorbic acid, retinol, retinal, retinoic acid, beta-carotene, 1,25-dihydroxycholecalciferol, 7-dehydrocholesterol, alpha-tocopherol, tocopherol, tocotrienol, menadione, menaquinone, phylloquinone, naphthoquinone, calcium, calcium carbonate, calcium sulfate, calcium oxide, calcium hydroxide, calcium apatite, calcium citrate-malate, calcium gluconate, calcium lactate, calcium phosphate, calcium levulinate, phosphorus, potassium, sulfur, sodium, docusate sodium, chloride, magnesium, magnesium stearate, magnesium carbonate, magnesium oxide, magnesium hydroxide, magnesium sulfate, copper, iodine, zinc, chromium, molybdenum, carbonyl iron, ferrous fumarate, polysaccharide iron, and combinations and derivatives thereof, without limitation. Derivatives of vitamin compounds include salts, alkaline salts, esters and chelates of any vitamin compound, without limitation. The non-prescription substances can also be a herbal compound, herbal extract, derivative thereof or combinations thereof, without limitation.

Pharmaceutical composition herein referred may take any form, and combinations thereof. Examples of such forms include, without limitation, chewable tablet, quick dissolve tablet, effervescent tablet, reconstitute powder, elixir, liquid, solution, suspension, emulsion, tablet, multi-layer tablet, bilayer tablet, capsule, soft gelatine capsule, hard gelatine capsule, caplet, lozenge, chewable lozenge, bead, powder, granules, dispersible granules, cachets, douche, suppository, cream, topical, inhalant, aerosol inhalant, patch, particle inhalant, implant, depot implant, dragee, ampoule, ingestible, injectable, infusion, health bar, liquid, food, nutritive food, functional food, yogurt, gelatine, cereal, cereal coating, animal feed or combinations thereof. The preparation of any of the above forms may be performed by techniques and methods well known and readily available to persons of ordinary skill in the art.

In a second aspect of the invention a method of manufacturing a medical package according to the first aspect of the invention is provided, the method comprising: processing a sheet of plastic material; filling the cavities with pharmaceutical compositions; attaching at least one cover sheet to the carrier halves so that the open sides of the cavities are sealingly covered by the at least one cover sheet; folding the carrier halves together so that the cavities intermesh, and folding the outer cover parts to adjacent the carrier halves.

In some embodiments according to the second aspect of the invention the folding of said carrier halves comprises: folding said carrier halves by 180° into an overlapping configuration so that the carrier halves lie on top of each other.

In some embodiments according to the second aspect of the invention the folding of said outer cover parts comprises: folding the outer cover parts by 180° into an overlapping configuration onto the carrier halves so that each outer cover part overlaps the carrier half to which is pivotally connected to.

In a third aspect of the invention a method of manufacturing a medical package according to the first aspect of the invention is provided, the method comprising: processing a sheet of a plastic material; filling the cavities with pharmaceutical compositions; attaching at least one cover sheet to the carrier halves so that the open sides of the cavities are sealingly covered by the at least one cover sheet; punching fully or partly through the sheet of plastic material at locations where the carrier halves are to be separated from the rims areas; attaching the outer foil to the rims areas; folding the carrier halves together so that the cavities intermesh, and joining the carrier halves.

Rims areas are defined as the areas of the carrier sheet adjacent to the rims.

Joining may be done by means of glue deposited before or after the folding.

In some embodiments according to the third aspect of the invention the folding of the carrier halves comprises: folding, before separating the carrier halves from said rims areas, the carrier halves and the rims areas by 180° into an overlapping configuration so that the carrier halves lie on top of each other.

In some embodiments according to the third aspect of the invention the folding of the carrier halves comprises: folding, after separating the carrier halves from the rims areas, the carrier halves by 180° into an overlapping configuration so that the carrier halves lie on top of each other.

In some embodiments according to the third aspect of the invention the punching is fully through the sheet of the plastic material allowing for folding of the carrier halves by 180° into an overlapping configuration so that the carrier halves lie on top of each other, while the rims areas remains unfolded in the same plane.

Processing may be thermoforming, vacuum forming or other processes that applied to sheets of plastic material can produce cavities, ridges, protrusions or indentation.

The methods described according to the second and the third aspect of the invention may have the advantage of producing in a more efficient and less costly way the medical package according to the first aspect of the invention.

The first and other aspects of the present invention may each be combined with any of the other aspects. These and other aspects of the invention will be apparent from and elucidated with reference to the embodiments described hereinafter.

In the following, a number of preferred and/or optional features, elements, examples and implementations will be summarized. Features or elements described in relation to one embodiment or aspect may be combined with or applied to the other embodiments or aspects where applicable. As an example, a feature or element described in relation to the opening system may be implemented as a step in the method where appropriate. Also, explanations of underlying mechanisms of the invention as realized by the inventors are presented for explanatory purposes, and should not be used in ex post facto analysis for deducing the invention.

BRIEF DESCRIPTION OF THE FIGURES

The single use medical package according to the invention will now be described in more detail with regard to the accompanying figures. The figures show one way of implementing the present invention and is not to be construed as being limiting to other possible embodiments falling within the scope of the attached claim set.

DETAILED DESCRIPTION OF AN EMBODIMENT

Figure 1:
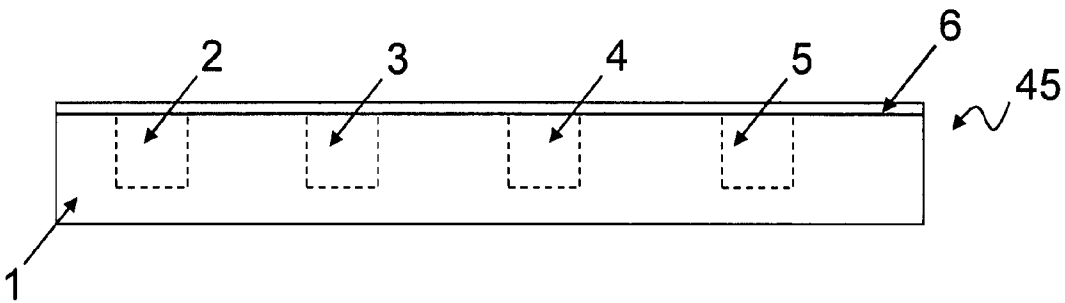
FIG. 1 shows a side view of a disposable package according to one embodiment of the invention.

FIG. 1 shows a side view of a disposable package 45 according to one embodiment of the invention. The package is shown containing a number of 4 cavities in its carrier. This is simply for descriptive reasons and should not be considered as a limitation to the scope of protection. Any commercially practicable number of cavities may be produced into a single carrier.

The package is characterized by a carrier 1 on which at least two but preferably a plurality of cavities 2-5 extending from the plane of the carrier 1 are present to house pharmaceutical compositions in different forms, e.g. capsule, tablets or pills.

The package also includes at least one cover sheet 6 at least partially sealed to the carrier 1 and around the cavities 2-5, protecting the pharmaceutical compositions contained in the cavities and allowing upon its removal the access to the cavities 2-5 housing the pharmaceutical compositions.

Figure 7:
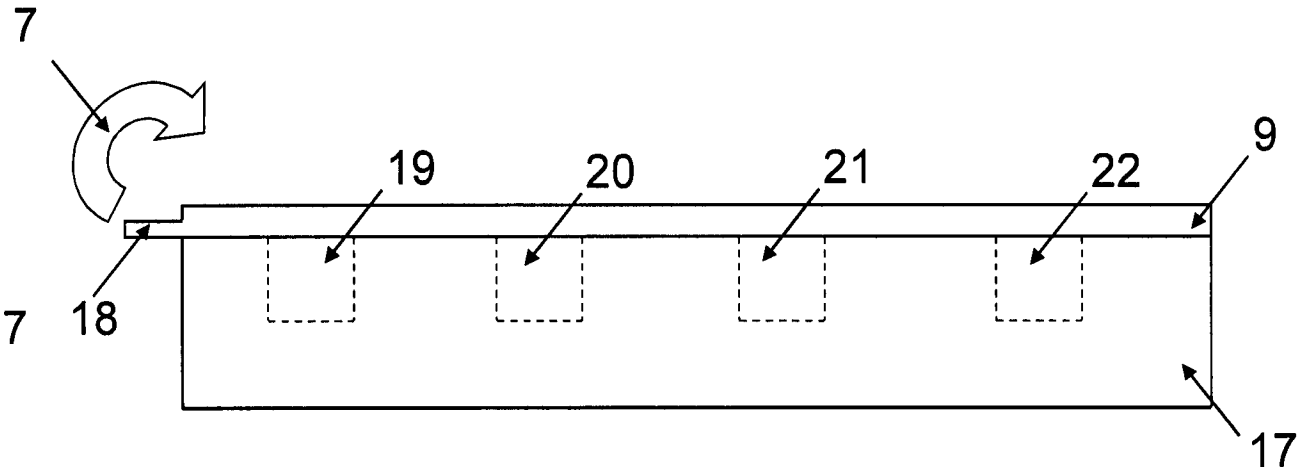
FIGS. 7 and 8 show different way to access the cover sheet for its removal.
Figure 8:
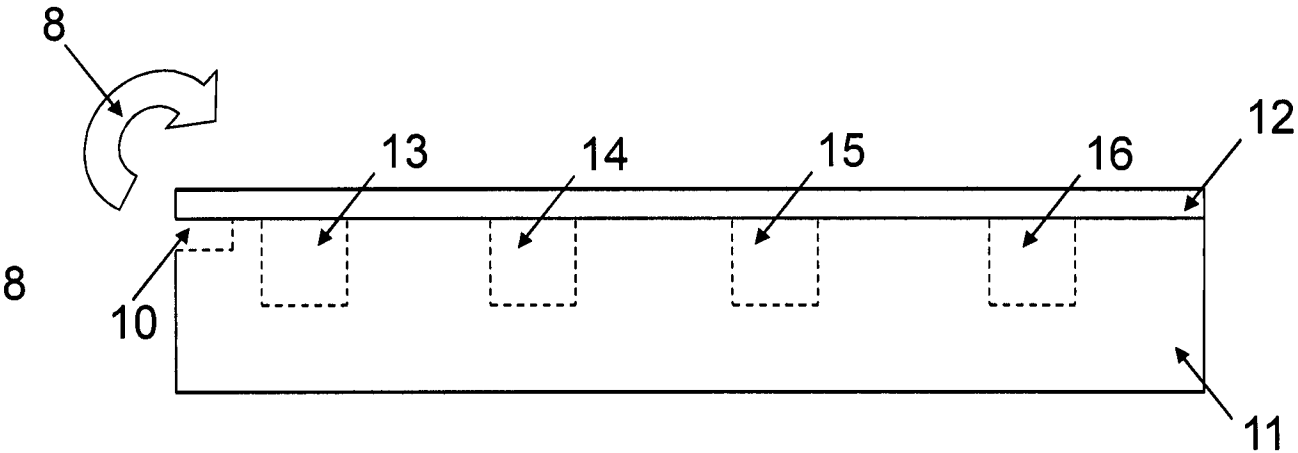

The access to the cavities 2-5 is gained by removal of the cover sheet which may be peeled off as shown by arrows 7 and 8 in FIGS. 7 and 8.

FIG. 8 shows a package according to an embodiment of the invention where a recess 10 is present on the carrier 11. This allows for an easy patient grip of the cover sheet 12. The access to cavities 13-16 is gained by gripping the cover sheet 12 through the access provided by recess 10 on the carrier 11 and by peeling or tearing off the cover sheet 12 following arrow 8, i.e. cover sheet 12 is pulled upwards and back following arrow 8.

While shown as an indentation into the carrier 11, recess area 10 may have different shape and form and be located in different areas of the carrier 11.

In another embodiment one or more recesses may be not present so that gripping of cover sheets may be made feasible by leaving a small portion of the cover sheet unsealed around part of the edges of the carrier or of the cavities.

FIG. 7 shows a package according to another embodiment of the invention where the cover sheet 9 has tab 18 which extends over the edge of the carrier 17. This allows for patient grip without the need of a recess area. The access to the cavities 19-22 is gained by gripping the tab 18 of the cover sheet 9 and by peeling or tearing tab 18 off so that the cover sheet 9 is pulled upwards and back following arrow 7.

In another embodiment the patient grip of the cover sheet of the package may be achieved by using a cover sheet which does not extend beyond the carrier edge and by leaving part of the cover sheet partially unsealed along the carrier edge.

Figure 8A:
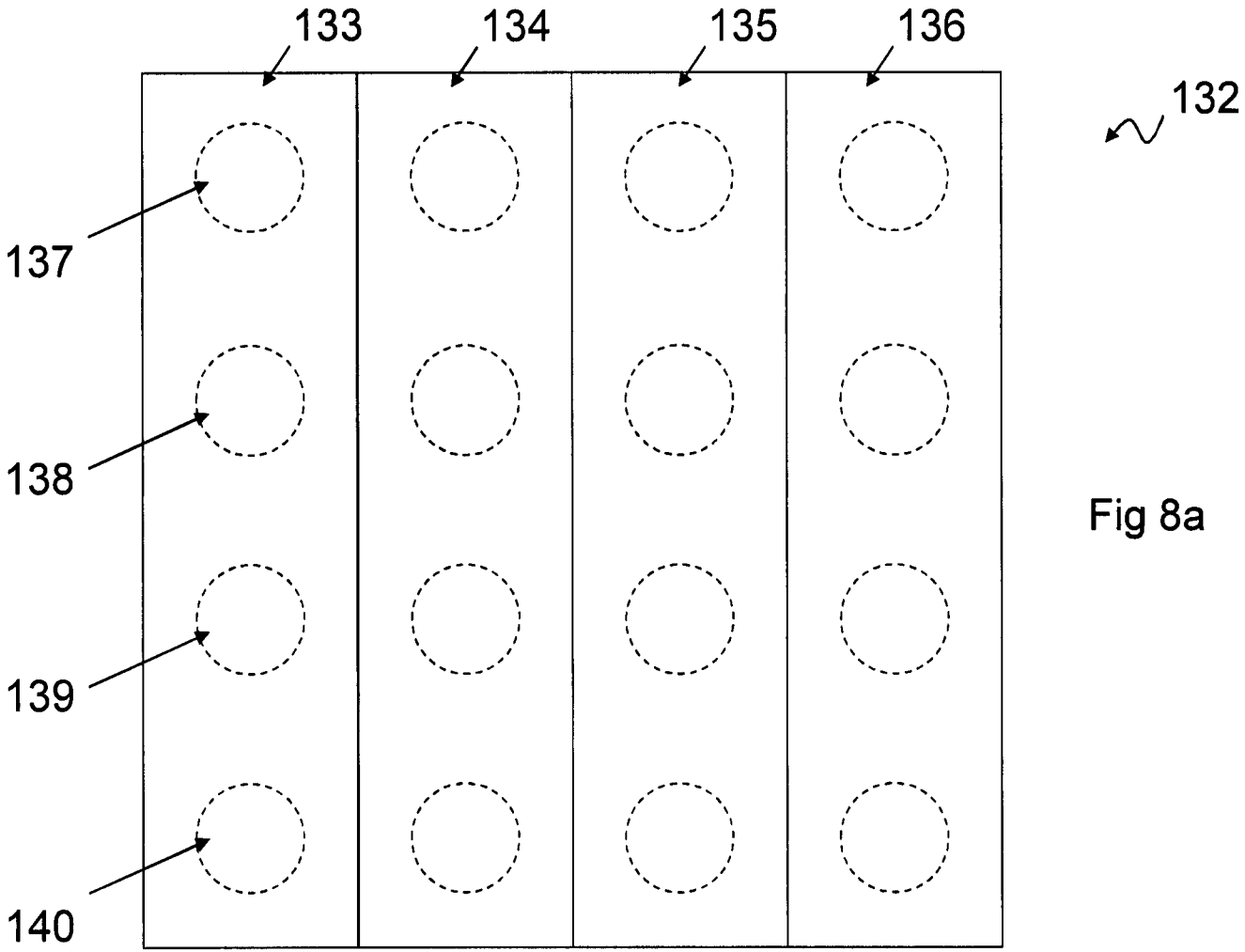
FIG. 8*a* shows a further embodiment of the invention where the blister package comprises four cover sheets.

In some embodiments the access to the multiple cavities may be provided by removal of a single cover sheet. For example in FIG. 8*a* shows a further embodiment of the invention where the blister package 132 comprises four cover sheets 133-136, each providing multiple access to 4 cavities. For example removal of cover sheet 133, by gripping pulling upwards and back cover sheet 133, provides access simultaneously to the cavities 132-140. In this way multiple dispensing of the pharmaceutical composition present in the cavities is achieved as by removal of a single cover sheet, several depressions are accessible. Access to cover sheets 133-136 may be possible by the presence of recess on the carrier or by presence of tab on the cover sheets or by leaving a small portion of the cover sheet unsealed around part of the edges of the carrier.

An advantage of these embodiments is that separated pharmaceutical compositions which may have interactions so that they need to be stored separately may be accessed through a single opening action, e.g. the removal of a single cover sheet provides access to multiple separated cavities.

In another embodiment the access to the cavities of the carrier may follow a specific sequence of opening. For example FIG. 9 shows an embodiment of the invention where the cover sheet is formed by several cover sheet overlapping.

Figure 9:
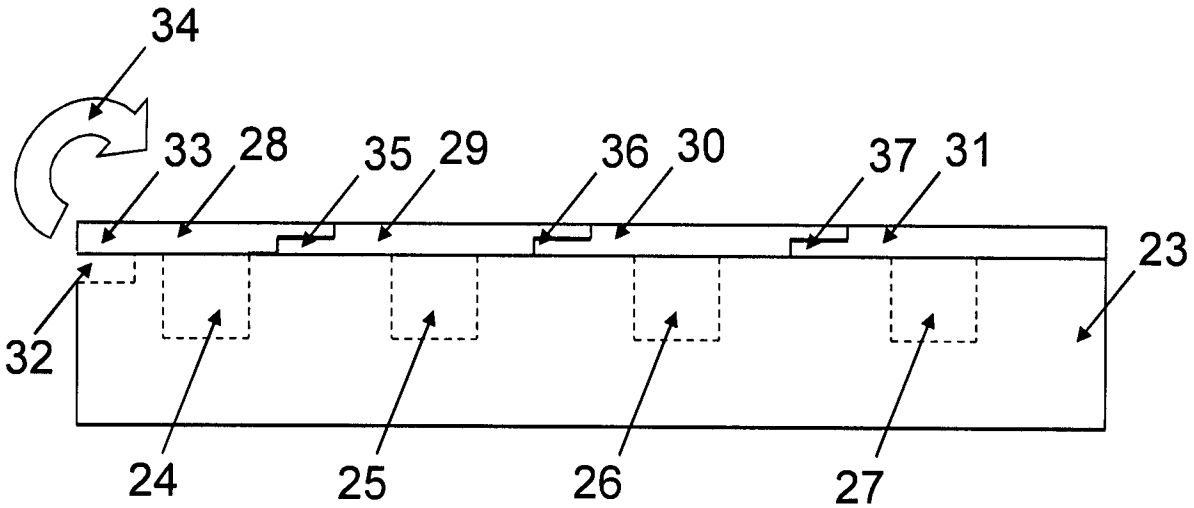
FIG. 9 shows an embodiment of the invention where the cover sheet is formed by several cover sheets overlapping.

FIG. 9 shows a disposable package which is characterized by a carrier 23 on which at least two but preferably a plurality of cavities 24-27 are present to house pharmaceutical compositions in different forms, e.g. capsule, tablets or pills. The package also includes a number of cover sheets 28-31 at least partially sealed to the carrier 23 and around the respective cavities 24-27, with the function of regulating access to the cavities 24-27 housing pharmaceutical compositions.

The cover sheets 28-31 are characterized in that the previous sheet partially overlap the following one so as to provide a predetermined and sequential access to the cavities 24-27 and therefore to the pharmaceutical compositions therein contained.

In some other embodiments (not shown) the previous cover sheets completely overlap the following ones.

Figure 9A:
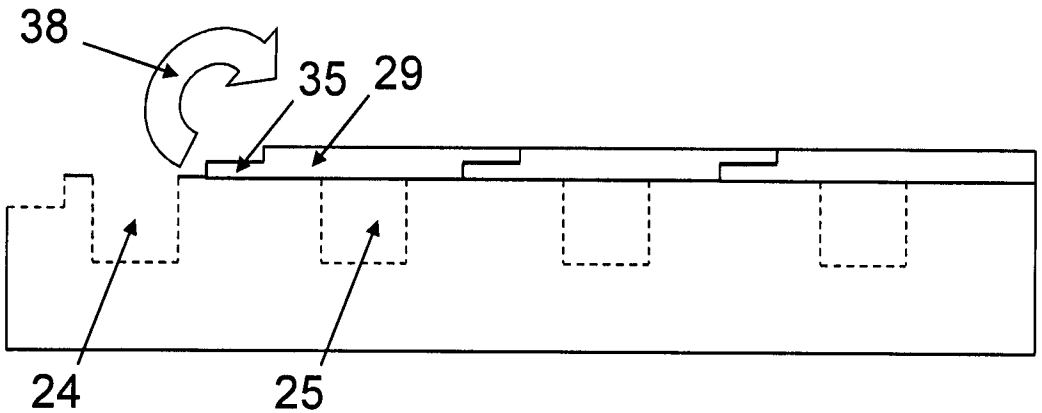
FIG. 9*a* shows the sequence of opening according to the embodiment of the invention in FIG. 9.

The carrier 23 may also have one or more recess, (here only one recess is shown, recess 32) being adjacent to each respective cavities. In FIG. 9 the first recess 32 is shown as a stepped recess with the function of leaving a small portion of the edge of the cover sheet 28 unsealed. Thus a tab 33 is created. By gripping the tab 33 of the cover sheet 28 and by peeling or tearing tab 33 off the cover sheet 28 is pulled upwards and back following arrow 34 and therefore removed providing access to the first cavity 24 containing a pharmaceutical composition. Upon removal of the cover sheet 28, as shown in FIG. 9*a*, cavity 24 is open and access to the tab 35, i.e. the overlapping area between cover sheet 28 and 29, for removing cover sheet 29, is obtained. A second recess (not shown) may be present to allow for gripping of tab 35 so that by peeling or tearing tab 35 off the cover sheet 29 is pulled upwards and back following arrow 38 and cover sheet 29 is removed providing access to cavity 25 and so on. In another embodiment one or more recesses may be not present so that gripping of cover sheets may be made feasible by leaving a small portion of the cover sheet unsealed around part of the edges of the respective depressions. The small portion may generally correspond to the overlapping area between the cover sheets or to the tab present in the previous cited embodiment.

Figure 2:
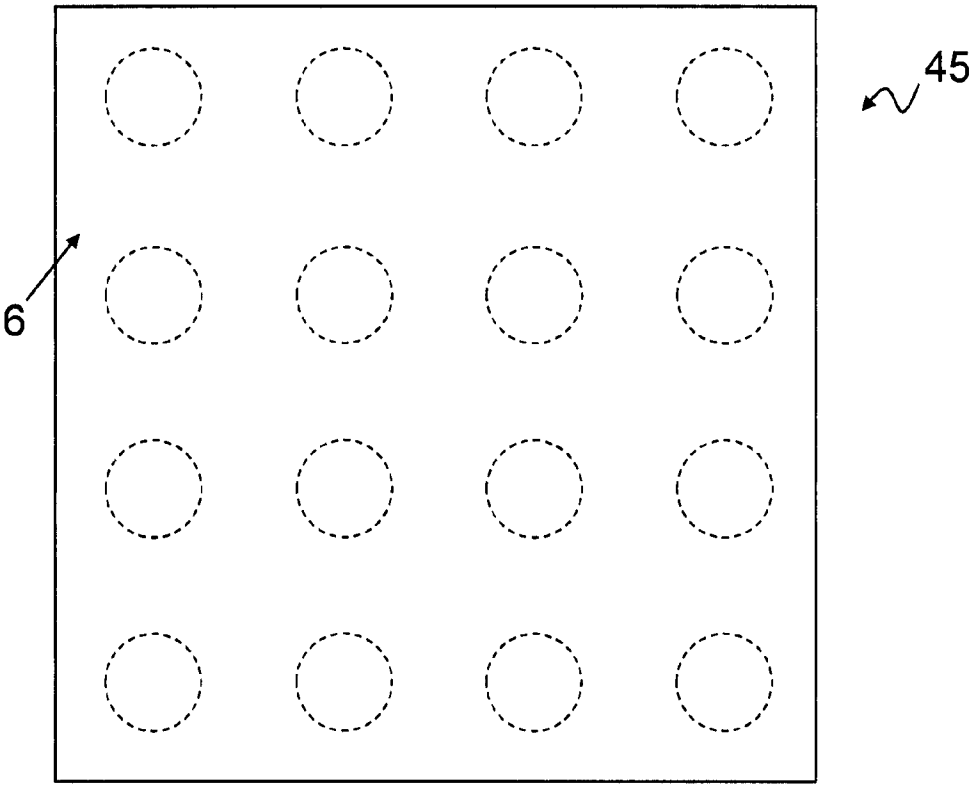
FIG. 2 shows a front view of a disposable package for medical use according to one embodiment of the invention.

FIG. 2 shows a front view of the disposable package shown in FIG. 1.

Figure 10:
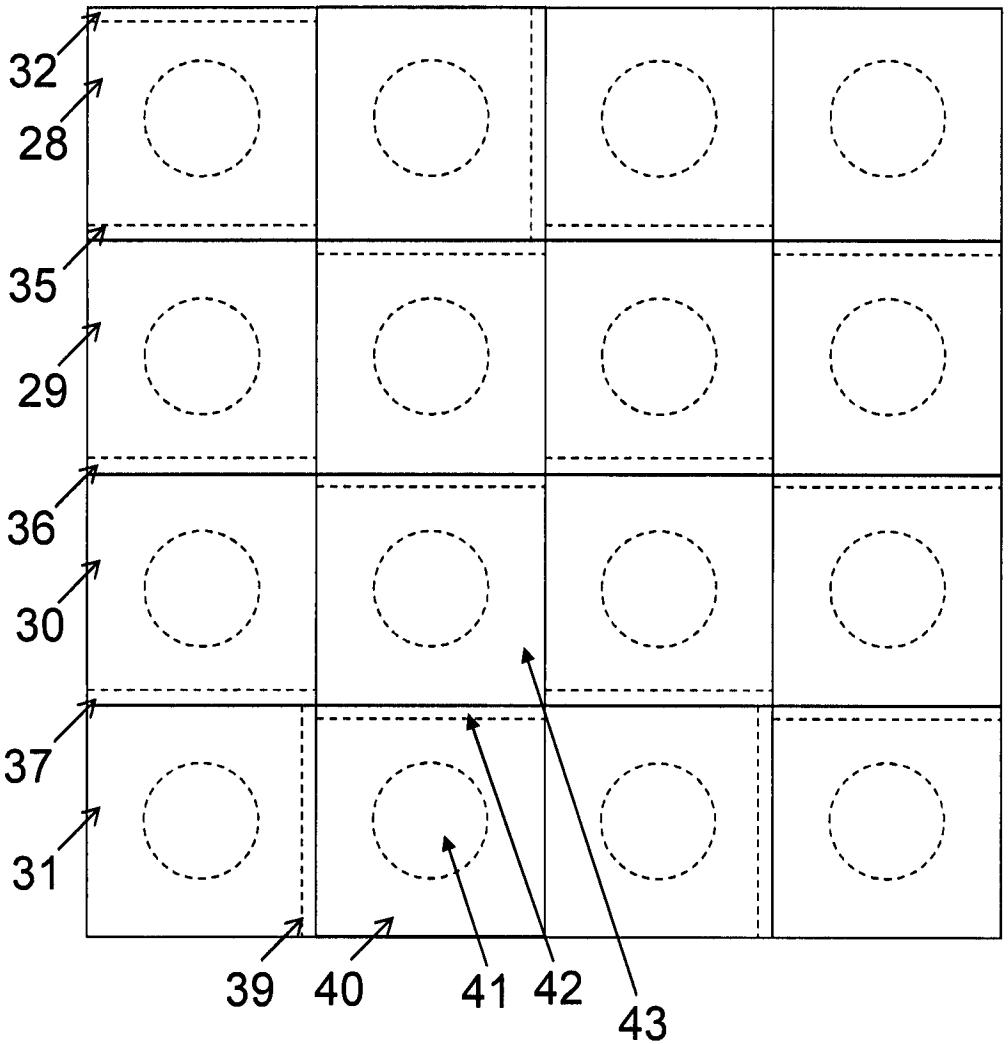
FIG. 10 shows a front view of a blister package according to one embodiment of the invention where the cover sheet is formed by several cover sheets overlapping.
Figure 10A:
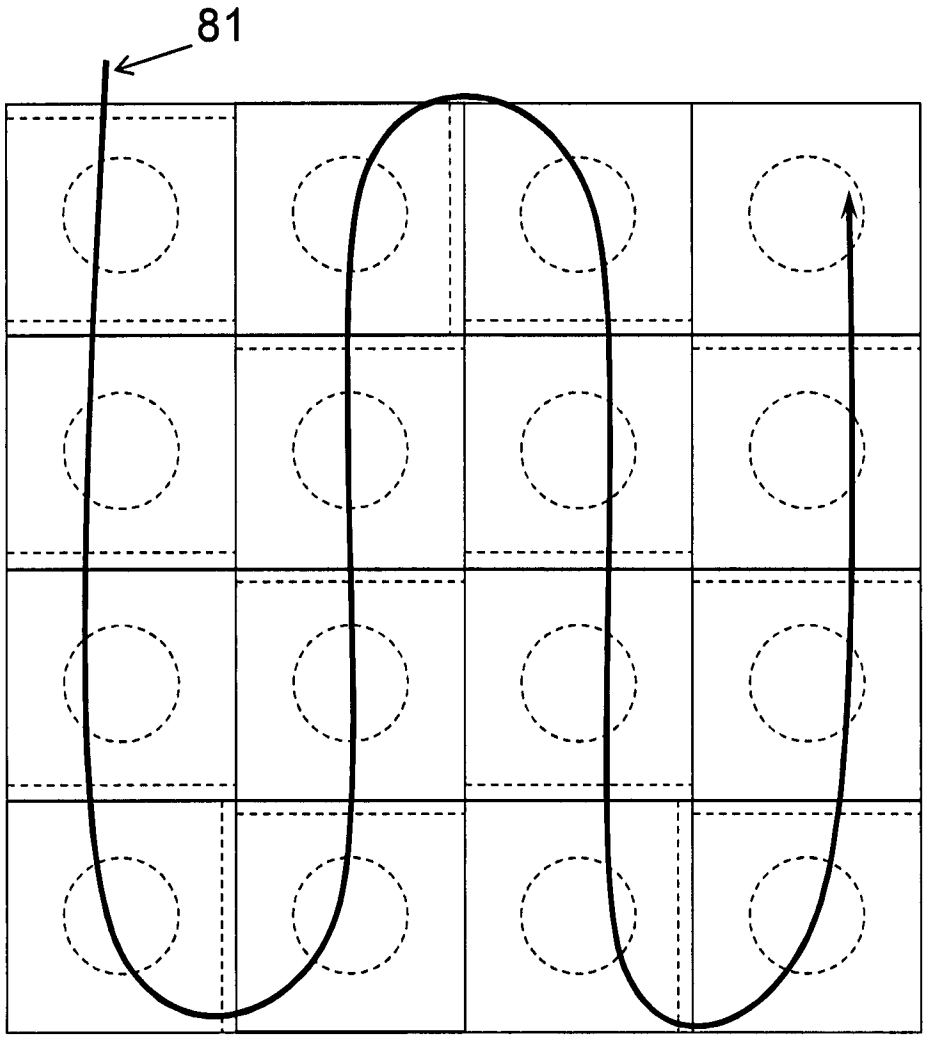
FIG. 10*a* shows the sequence of opening according to the embodiment of the invention in FIG. 10.

While in this embodiment 16 cavities are shown, this is simply for descriptive reasons and should not be considered as a limitation to the scope of protection. Any commercially practicable number of cavities may be produced into a single disposable package. The access to the different cavities is gained by removal of the cover sheet following the description of FIG. 7, 8 or 9. In particular when the cover sheet is a series of overlapping sheets as described by FIG. 9 the opening may follow a sequence that can be predetermined by providing a specific overlapping of the cover sheets. As shown by FIGS. 9 and 9*a* the overlapping areas 35-37 between the cover sheets 28-31 determine the sequence of access. FIG. 10 shows also cover sheet 40 and tab 39. Cover sheet 31 hinders access to tab 39, so that to the removal of cover sheet 31 follows the removal of cover sheet 40 allowing access to depression 41. Accordingly cover sheet 43 can be removed by peeling or tearing off tab 42, which can be accessed only following removal of cover sheet 40. In FIG. 10*a* the sequence of access to the several depressions, following arrow 81 is obtained by using an overlapping between cover sheets and tab as shown in FIG. 10.

Several opening direction may be obtained by predetermined overlapping sequence, e.g. round, zig-zag, up-down, left-right or by using multiple staring points.

Figure 2A:
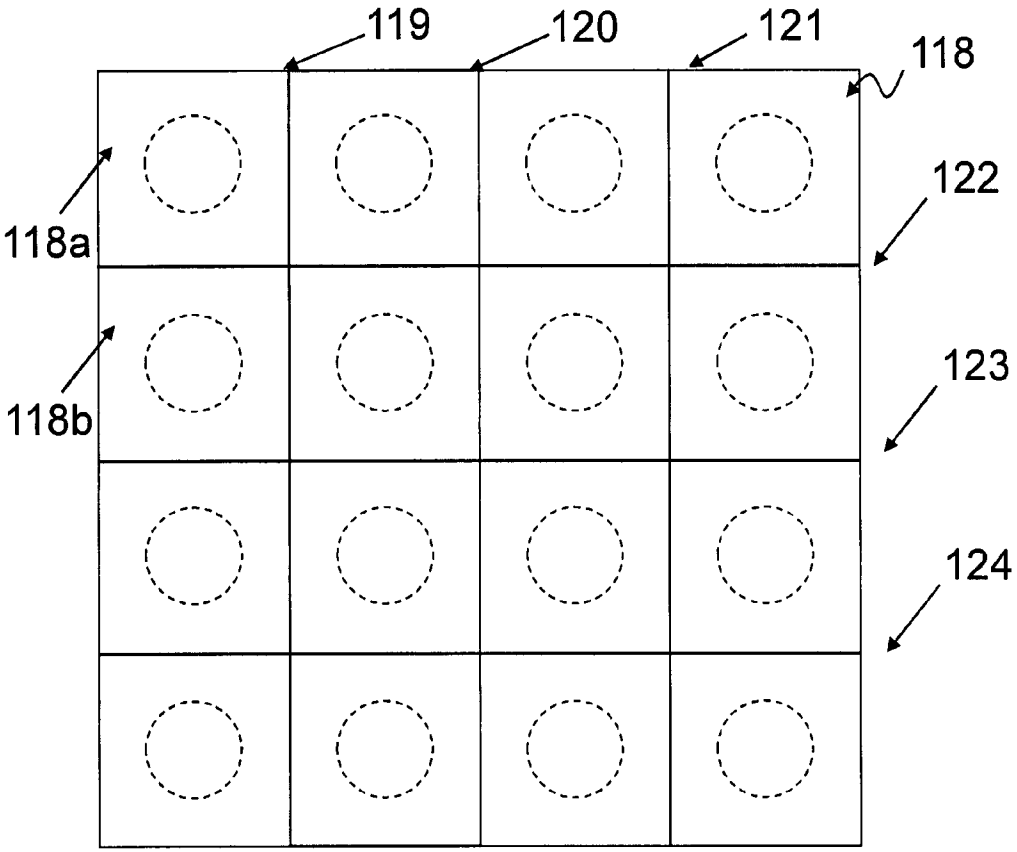
FIG. 2*a* shows a front view of a disposable package for medical use according to one embodiment of the invention where the cover sheet is perforated along specific lines.

FIG. 2*a* shows a front view of the disposable package shown in FIG. 1 where the access to the different cavities is gained by removal of cover sheet 118 which is perforated along some specific lines 119-124 so as to provide only access to a single cavity and to the pharmaceutical composition herein contained at a time. In some other embodiments the perforation of the cover sheet 118 may be carried out also through all the carrier thickness, therefore identifying discrete sections, e.g. 118*a* and 118*b*, which are fully detachable from the package and contain a single pharmaceutical composition.

Figure 1A:
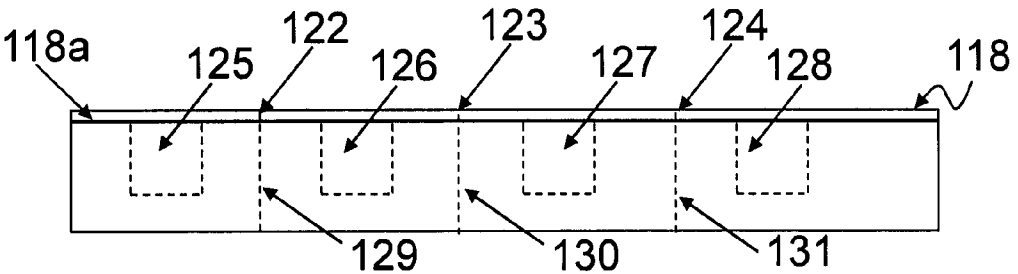
FIG. 1*a* shows a side view of a disposable package for medical use according to one embodiment of the invention where the cover sheet is perforated along specific lines.

FIG. 1*a* shows a side view of the disposable package for medical use shown in FIG. 2*a*. Cover sheet 118 is perforated along the lines 122-124 so as to provide access to cavities 125-128. Access to cavity 125 is gained by removal of part of the cover sheet 118, i.e. 118*a*. In some embodiments the perforation is carried through the carrier as shown by lines 129-131.

Figure 3:
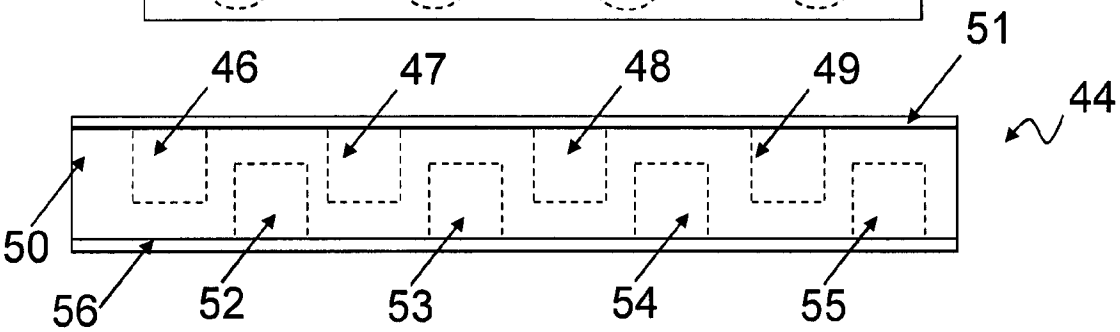
FIG. 3 shows a side view of a disposable package for medical use according to the embodiment of the invention where cavities are present onto top and bottom surface of the carrier.

FIG. 3 shows a side view of a disposable package for medical use according to the embodiment of the invention where cavities are present onto top and bottom surface of the carrier. The disposable package 44 has cavities 46-49 on the top surface of carrier 50. These cavities are accessible by removal of cover sheet 51. On the bottom surface of carrier 50 cavities 52-55 are located off-set in respect to cavities 46-49 in an intermeshing fashion. Cavities 52-55 are accessible by removal of cover sheet 56. In this way double of the amount of pharmaceutical compositions, such as pills tablets or capsules may be transported in a package having the same dimension and hindrance of the one shown by FIGS. 1 and 2.

In some other embodiments the carrier 50 is characterized in that the rigid structure is a hollow rigid structure, i.e. no material is present between the cavities of the carrier. The carrier in these embodiments comprises a rigid and thin structure of plastic material, which may be closed at the sides.

Figure 3A:
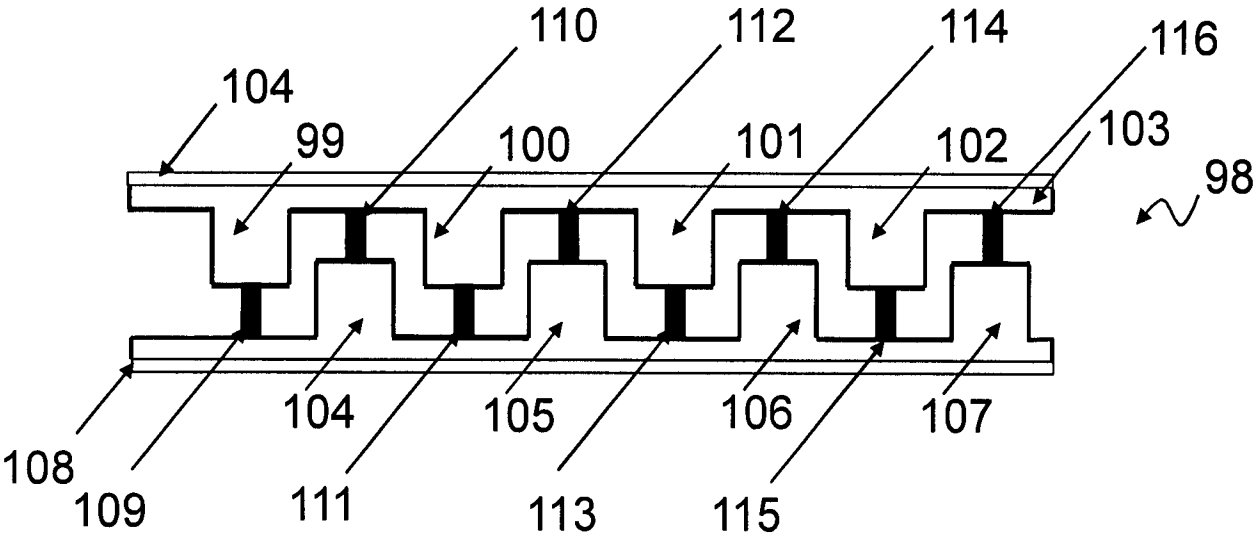
FIG. 3*a* shows a front view of a disposable package for medical use according to the embodiments of the invention where the rigid structure is a hollow structure.
Figure 3B:
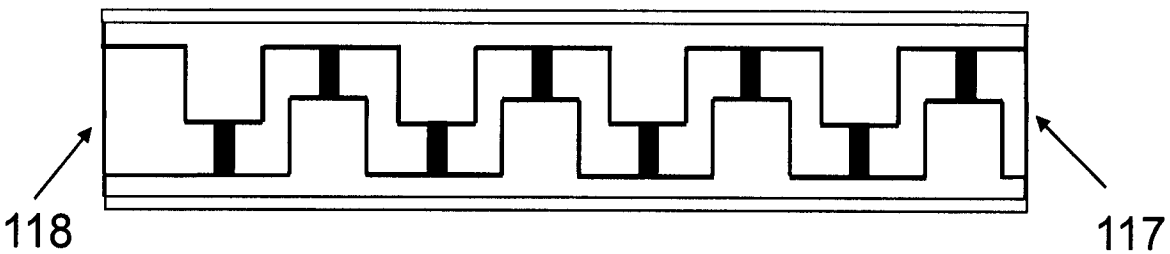
FIG. 3*b* shows a front view of a disposable package for medical use according to the embodiments of the invention where the rigid structure is a hollow structure and two side walls of the structure are present.

FIG. 3*a* shows a section view of a disposable package for medical use according to the embodiments of the invention where the rigid structure is a hollow structure.

The disposable package 98 has cavities 99-102 on the top surface of carrier 103. These cavities are accessible by removal of cover sheet 104. On the bottom surface of carrier 103 cavities 104-107 are located off-set in respect to cavities 99-102 in an intermeshing fashion. Cavities 104-107 are accessible by removal of cover sheet 108. The area between the top on bottom surface of the carrier 103 is hollow, e.g. empty and may be filled with air or gases. Supporting elements, e.g. 109-116, may be present to provide rigidity to the structure. These elements may be supporting lines or columns. These elements may be made of the same or different material of the carrier. The advantage of this structure is the light weight and the minimized use of material for its production. In some other embodiments the rigid structure may have at least one side wall connecting the top and the bottom surface of the carrier. FIG. 3 *b* shows the same embodiment of FIG. 3*a* where two side walls 117 and 118 of the structure are present. In other embodiments the opening systems disclosed in FIG. 1*a*, 7, 8, 9, 9*a*, 10 or 10*a* may be applied used on the disposable package described by this embodiment.

While in this embodiment 32 cavities are shown, this is simply for descriptive reasons and should not be considered as a limitation to the scope of protection.

Figure 4:
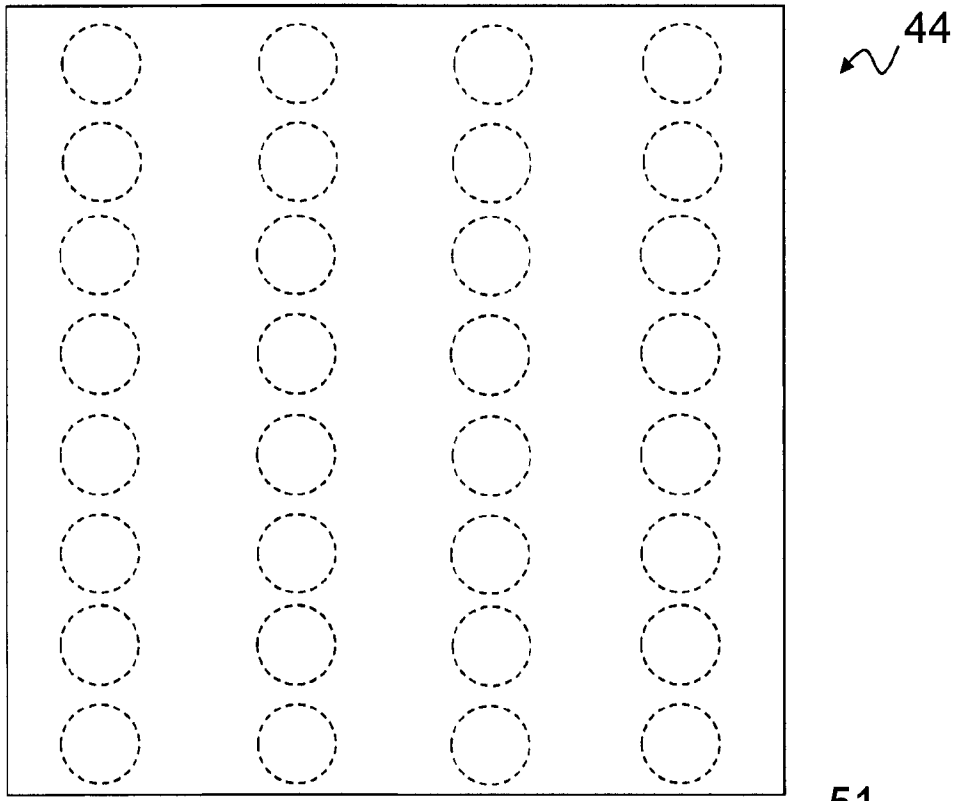
FIG. 4 shows a front view of a disposable package for medical use according to the embodiments of the invention where cavities are present onto top and bottom surface of the carrier.

FIG. 4 shows a front view of the disposable package shown in FIG. 3. For comparative reasons it is shown that 32 cavities are possible in this configuration for a carrier having the same dimension of the carrier shown in FIG. 2.

Figure 4A:
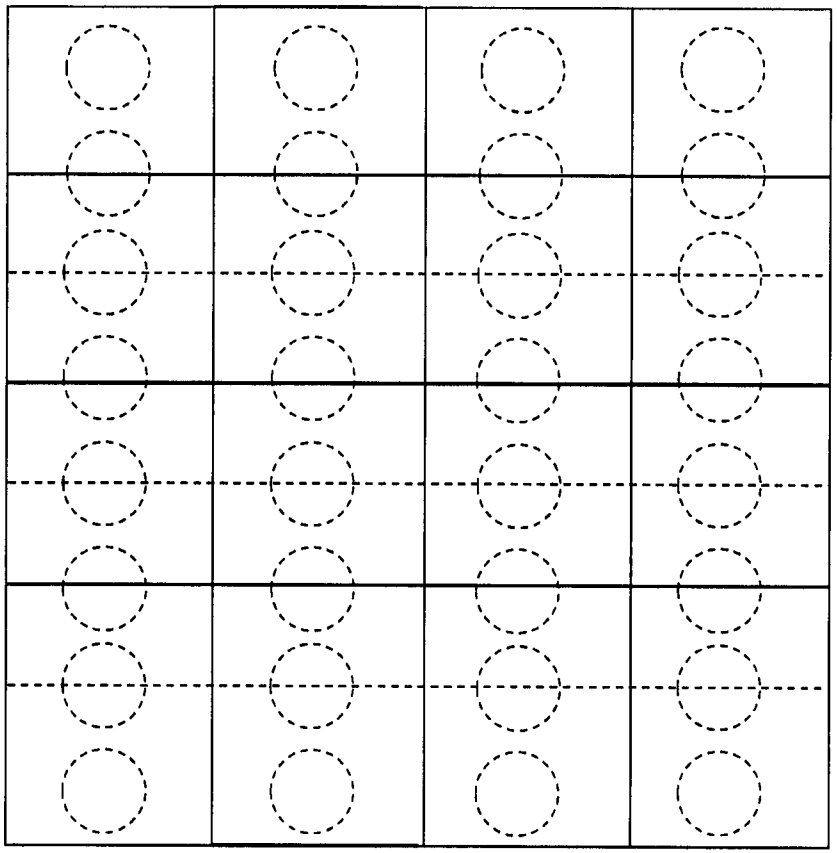
FIG. 4*a* shows a front view of a disposable package for medical use according to the embodiments of the invention where cavities are present onto top and bottom surface of the carrier, where the cover sheet is perforated along specific lines.

FIG. 4*a* shows a front view of the disposable package shown in FIG. 3 where the cover sheet is perforated along specific lines so as to provide only access to a single cavity and to the pharmaceutical composition herein contained at a time in analogy of the embodiment shown in FIG. 2*a*.

Figure 11A:
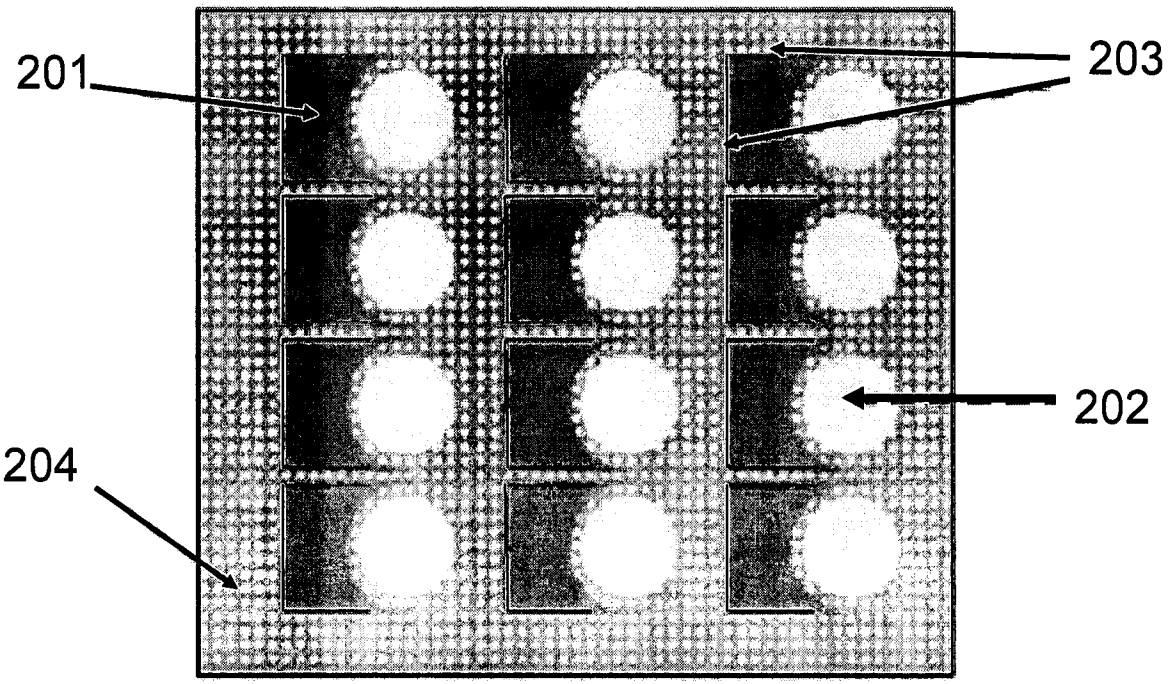
FIG. 11*a* shows schematically a top view of an embodiment of the invention.
Figure 11B:
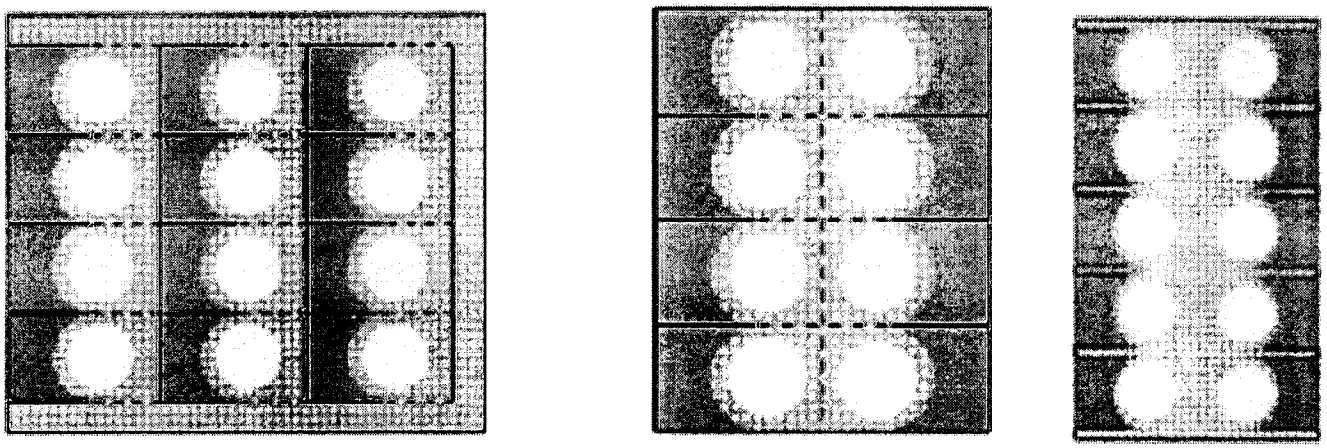
FIG. 11*b* shows different embodiments having different arrangements of the flaps and cavities.

FIG. 11*a* shows schematically a top view of an embodiment of the invention where a flap 201 is provided next to each cavity 202. The flaps 201 are obtained by leaving the areas underneath each flap 201 unsealed during manufacturing when the cover sheet is fastened to the carrier. In a, preferably subsequent, process step, the edges 203 of the flaps 201 are separated from the sealed part 204 of the cover sheet, typically by punching. The punching can be either through the cover sheet only or fully or partly through the carrier as well. An advantage of punching through the cover sheet only is that the carrier is left intact and thereby stiffer and less prone to failure. An advantage of allowing the punching to go fully or partly through the carrier is that the tolerances on the punching tools and the punching action can be less strict. FIG. 11*b* shows different embodiments having different arrangements of the flaps and cavities.

Figure 12B:
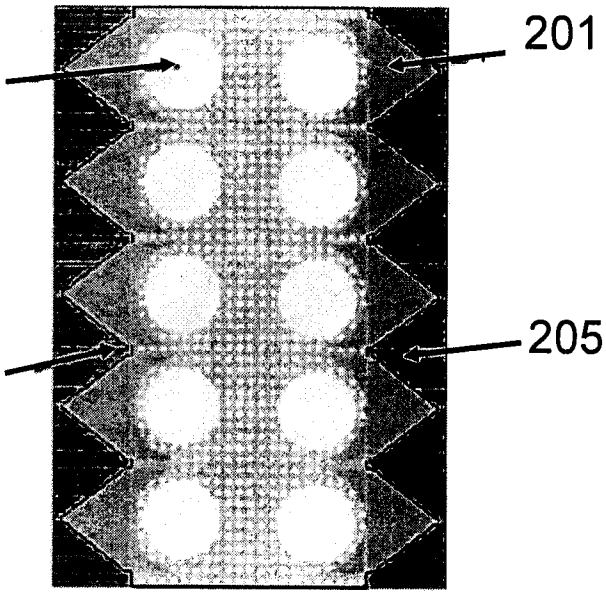
FIGS. 12*a* and 12*b* show schematically a top view of an embodiment of the invention where part of the cover sheet is removed during or after the punching process.
Figure 12A:
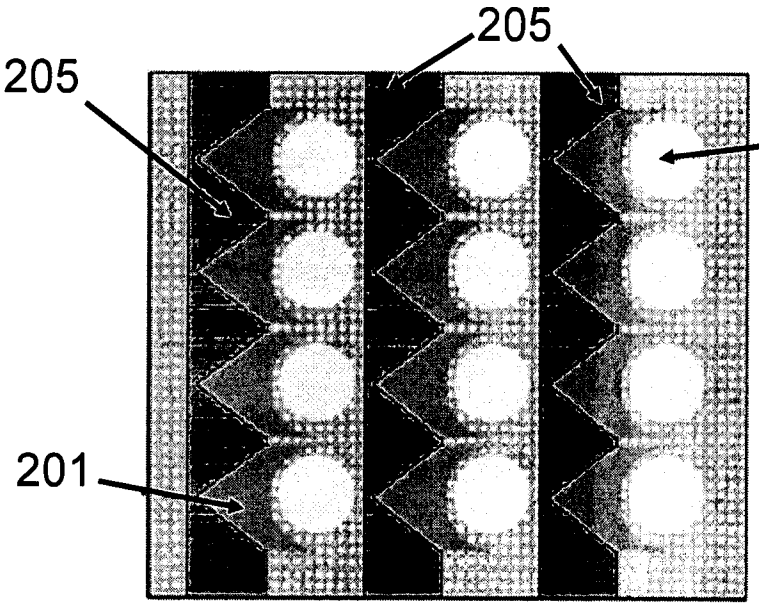

In an alternative embodiment to the one shown in FIGS. 11*a* and 11*b*, selected parts of the cover sheet are removed during or after the punching process. An example of such an embodiment is shown schematically in FIGS. 12*a* and 12*b*. The part of the cover sheet being removed is marked as 205 in the figures. This process may result in the flaps 201 being easier to grip. As shown in FIG. 12*b*, the cover sheet may project over the edges of the carrier e.g. by an amount corresponding to the size of the flaps 201 and the parts 205 of the cover sheet being removed. Hereby the flaps 201 may be even easier to grip than when they overlap the carrier.

Figure 13B:
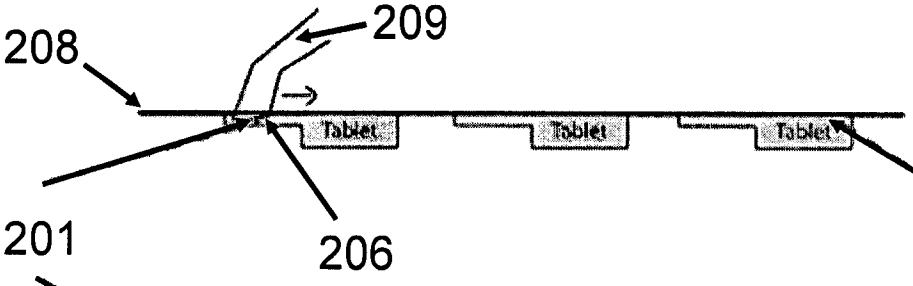
FIG. 13*b* shows a cross section of the embodiment of the invention of FIG. 13*a*.
Figure 13A:
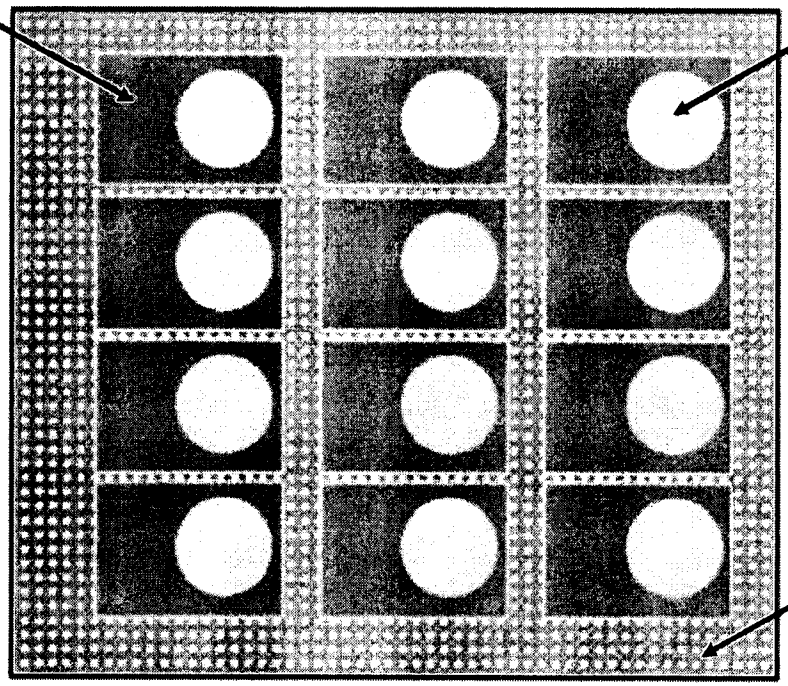
FIG. 13*a* shows schematically a top view of an embodiment of the invention where parts of the cover sheet are left unsealed.

In still another embodiment shown schematically in FIGS. 13*a* and 13*b*, parts of the cover sheet are left unsealed to the carrier as in the embodiment in FIGS. 11*a* and 11*b*. The embodiments differ in that in the one shown in FIGS. 13*a* and 13*b*, the manufacturing does not include the providing of flaps 201 by punching. Instead there is a recess 206 next to each cavity 207, and to gain access to the content of a cavity, the cover sheet 208 is pressed into the recess 206 and the cover sheet 208 is removed from above the actual cavity 207. This action is typically performed by using a finger 209, but an appropriate tool could also be used. In this embodiment, the cover sheet 208 is preferably sealed to the carrier over the whole area not being a recess 206 or a cavity 207. An advantage of this embodiment is that no punching step is needed in the manufacturing process.

Figure 5:
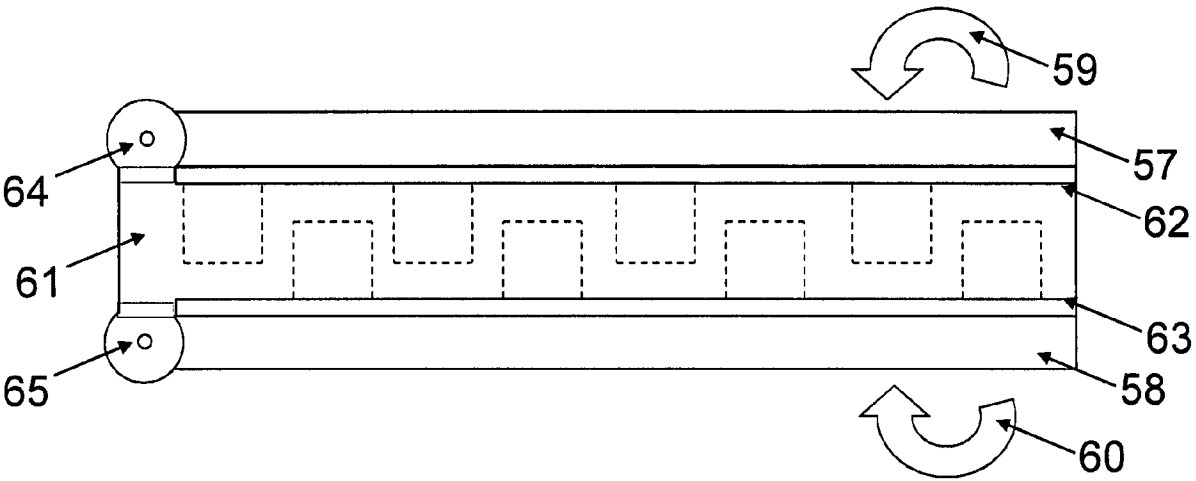
FIG. 5 shows a side view of a disposable package for medical use according to one embodiment of the invention where cavities are present onto top and bottom surface of the carrier and the access to the cover sheets is protected by a lid.
Figure 5A:
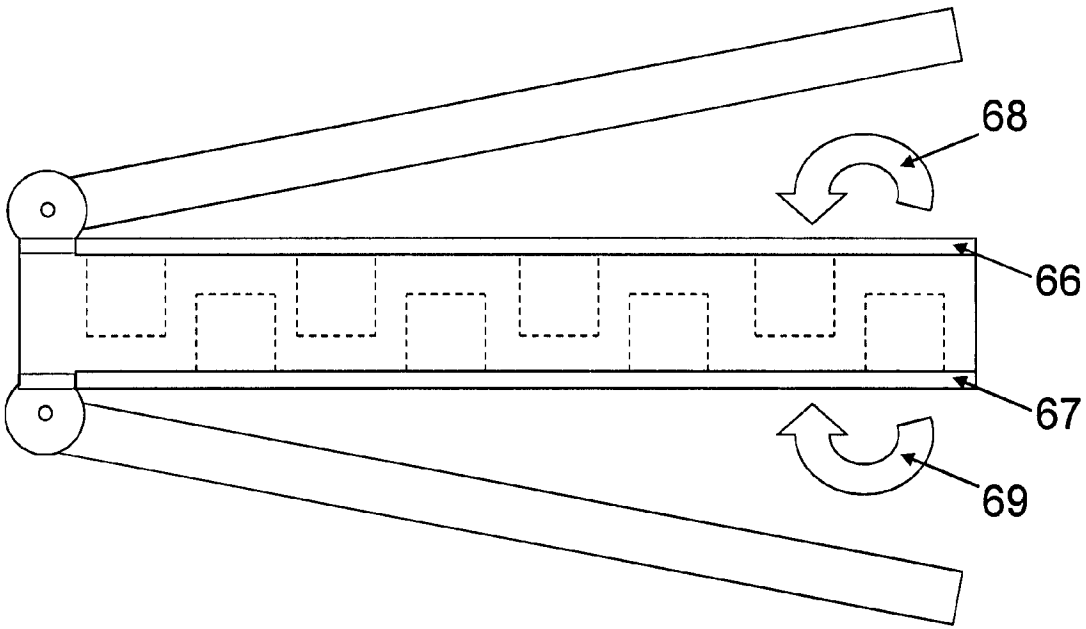
FIG. 5*a* shows the sequence of opening according to the embodiment of the invention in FIG. 5.

FIG. 5 shows a side view of a disposable package for medical use according to the embodiment of the invention where cavities are present on the top and the bottom surface of the carrier and the access to the cover sheets is protected by two lids 57 and 58. The lids 57 and 58 are hinged to the same end of carrier 61 but onto top and bottom surface 62 and 63 respectively. Hinges 64 and 65 enable lids 57 and 58 to be moved between open and closed position following a movement along arrows 59 and 60 respectively as shown in FIG. 5*a*. Once in the open position the access to cover sheets 66 and 67 is possible and removal of the cover sheets following arrows 68 and 69 leads to access to the underneath cavities.

Figure 6:
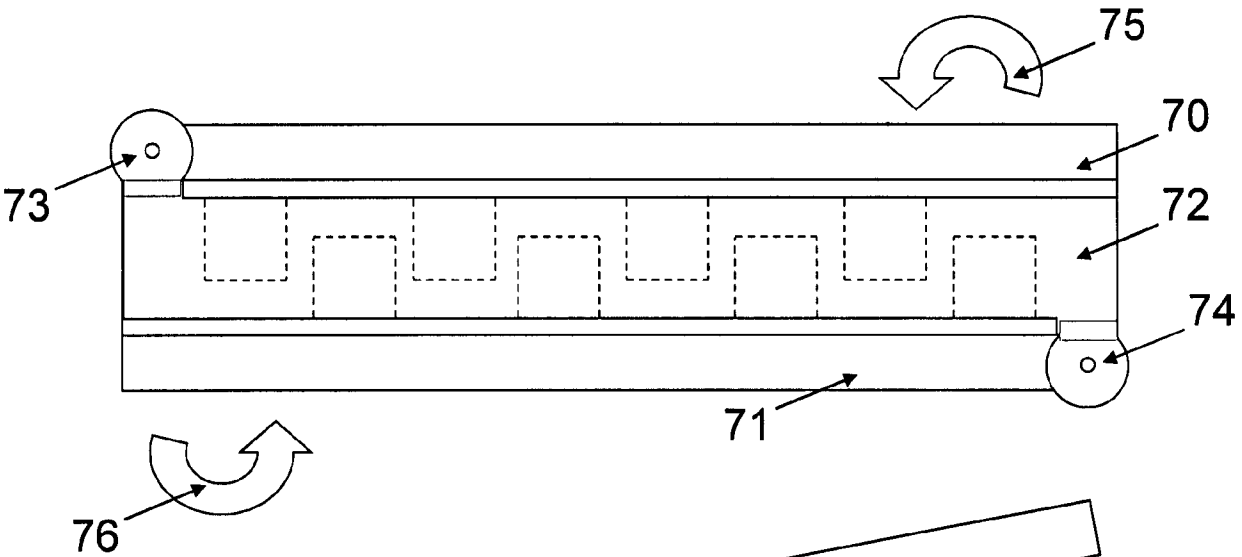
FIG. 6 shows a side view of a disposable package for medical use according to another embodiment of the invention where cavities are present onto top and bottom surface of the carrier and the access to the cover sheets is protected by a lid.
Figure 6A:
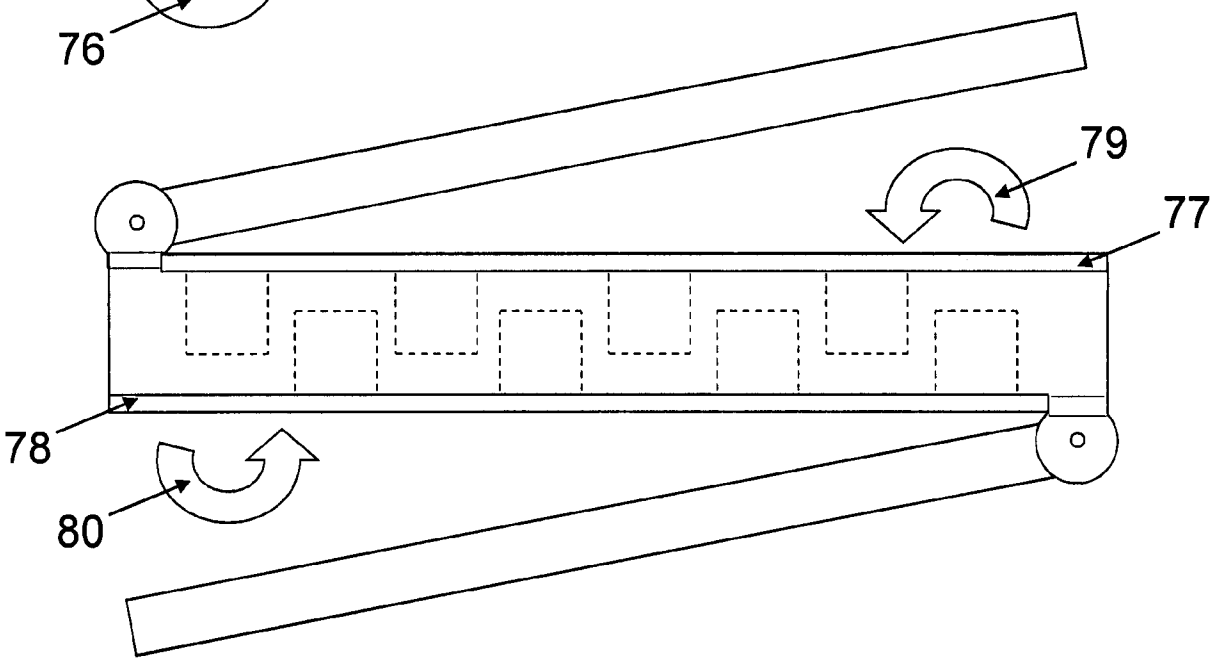
FIG. 6*a* shows the sequence of opening according to the embodiment of the invention in FIG. 6.

FIG. 6 shows a side view of a disposable package for medical use where the access to the cover sheets is protected by two lids 70 and 71 hinged to opposite end of carrier 72. Hinges 73 and 74 enable lids 70 and 71 to be moved between open and closed position following an asymmetric movement along arrows 75 and 76 respectively as shown in FIG. 6*a*. Once in the open position the access to cover sheets 77 and 78 is possible and removal of the cover sheets following arrows 79 and 80 leads to access to the underneath cavities.

Figure 6B:
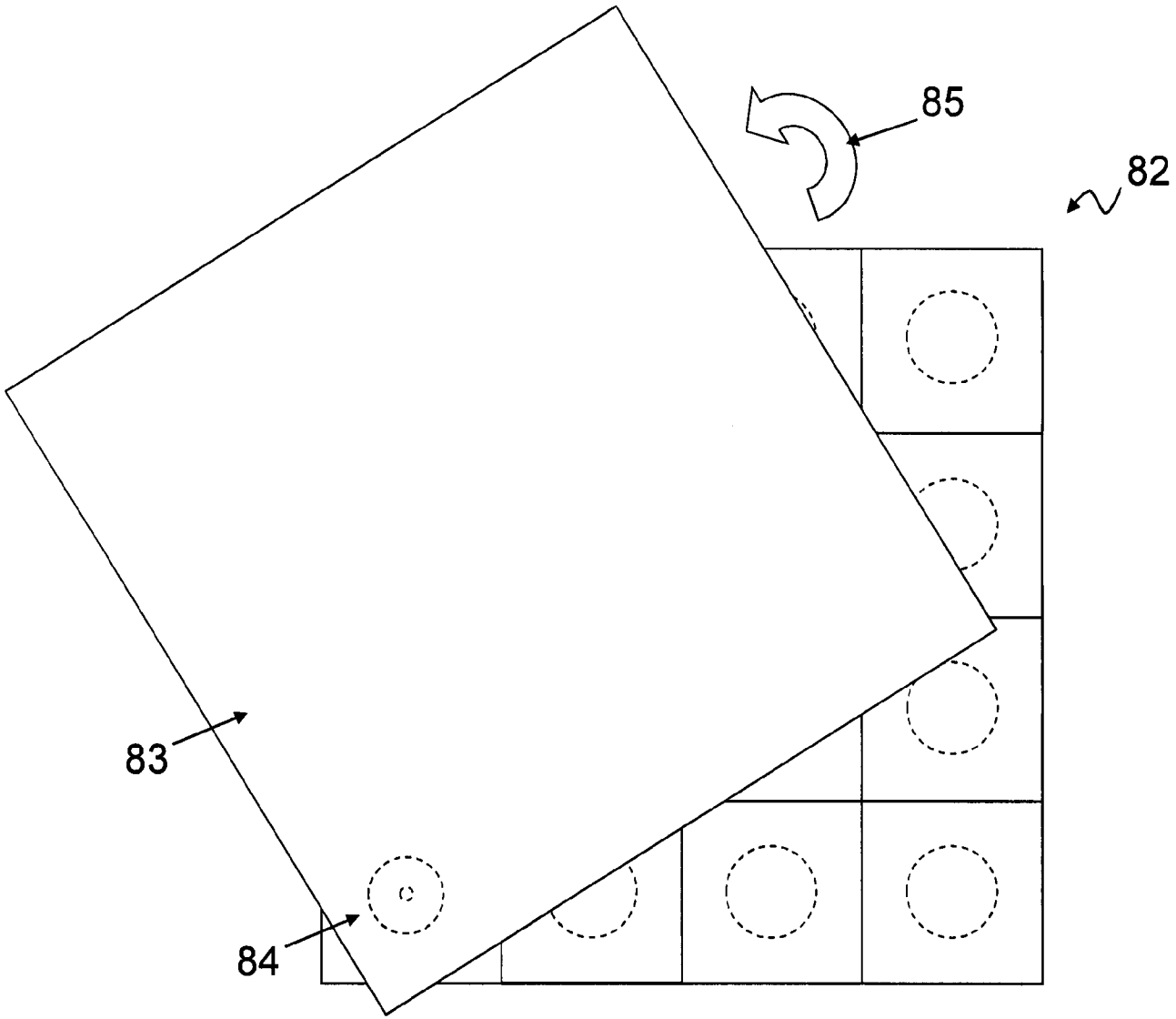
FIG. 6*b* shows a front view of a disposable package for medical use according to the embodiments of the invention where the package comprises a rotational joint.

FIG. 6*b* shows a front view of a disposable package for medical use 82 where the access to the cover sheets is protected by a lid 83, or by two lids in case cavities are present onto top and bottom surface of the carrier. In this embodiment the cover sheet is protected by lid 83 which can be opened by a rotational movement along the axis of hinge 84, so that lid 83 can rotate laterally following arrow 85. Closure of the lid may be obtained by the opposite rotational movement.

Hinge 84 may be a pivot hinge or any rotational joint which allow the rotational movement showed in FIG. 6*b*.

Figure 6D:
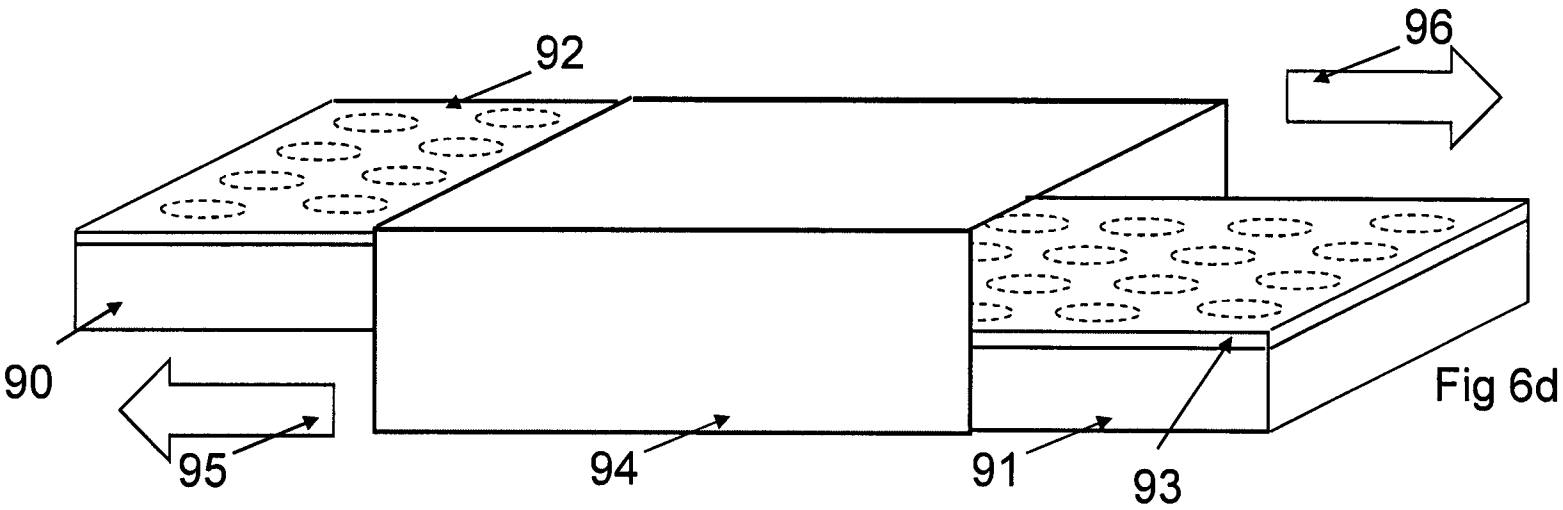
FIG. 6*d* shows a 3 dimensional view of a disposable package for medical use where the hollow rectangular body with the function of a lid protects two carriers.
Figure 6C:
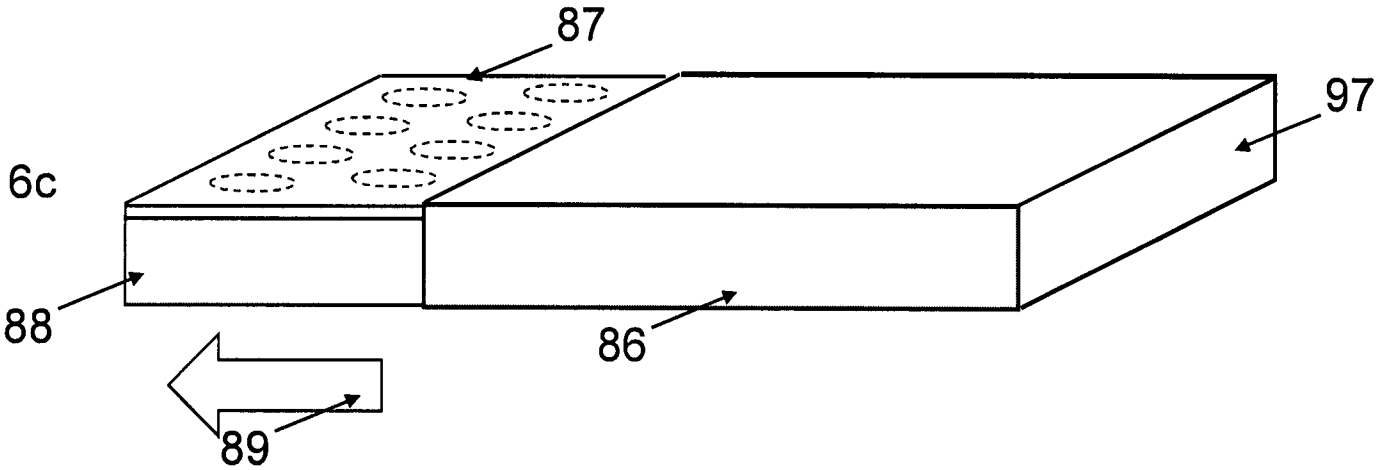
FIG. 6*c* shows a 3 dimensional view of a disposable package for medical use where the protection to the cover sheet is provided by an hollow rectangular body with the function of a lid.

FIG. 6*c* shows a 3 dimensional view of a disposable package for medical use where the protection to the cover sheet is provided by a hollow rectangular body 86 with the function of lid. To gain access to the cover sheet 87 protecting the carrier 88 a lateral sliding movement of the carrier 88 is required by following arrow 89.

In other embodiments, carriers and cover sheets and opening system disclosed in previous embodiments, e.g. in FIG. 1, 1*a*, 3, 7, 9, 10 or 10*a* may be applied to this embodiment.

FIG. 6*d* shows a similar embodiments to FIG. 6*c* where two carriers 90 and 91 and their respective cover sheets 92 and 93 are protected by a hollow rectangular body 94 with the function of lid. To gain access to the cover sheet 92 protecting the carrier 90 a lateral sliding movement of the carrier 90 is required by following arrow 95. Accordingly to gain access to the cover sheet 93 protecting the carrier 91*a* lateral sliding movement of the carrier 91 is required by following arrow 96. The carrier and cover sheet shown are for simplicity shown with cavities only on one surface of the carrier. In other embodiments, carriers and cover sheets may be the one described in the previous embodiments, e.g. in FIG. 1, 1*a*, 3, 7, 9, 10 or 10*a*.

In other embodiments the hollow rectangular body may have only a single opening to the hollow, e.g. in FIG. 6*c* the body 86 has also a lateral wall 97.

In these embodiments described by FIGS. 6*b*, 6*c* and 6*d* the open space between the cover sheets and the lid, e.g. the hollow body, may be used for carrying a leaflet with information of interest to the patient, e.g. instructions on how to use the pharmaceutical compositions contained, or commercial for related medicaments. In some embodiments the carrier may be produced by a single injection moulding process. In these and other embodiments the top and the bottom surface of the carrier may be produced separately and then welded together.

In some embodiments the hollow body 94 or 86 may have the function of an envelope, so the carrier, cover sheet and the pharmaceutical compositions therein contained can be sent by standard mail. In these embodiments hollow body 94 or 86 may have the receiver address provided, e.g. printed or attached through a label, on one of the external surfaces of the hollow body.

Figure 6E:
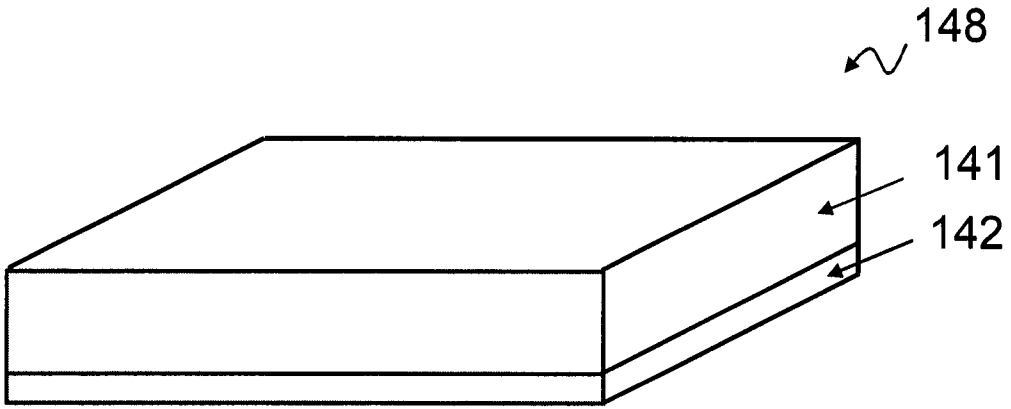
FIG. 6*e* shows a 3 dimensional view of a disposable package for medical use where the protection to the cover sheet is provided by a fully removable lid.
Figure 6F:
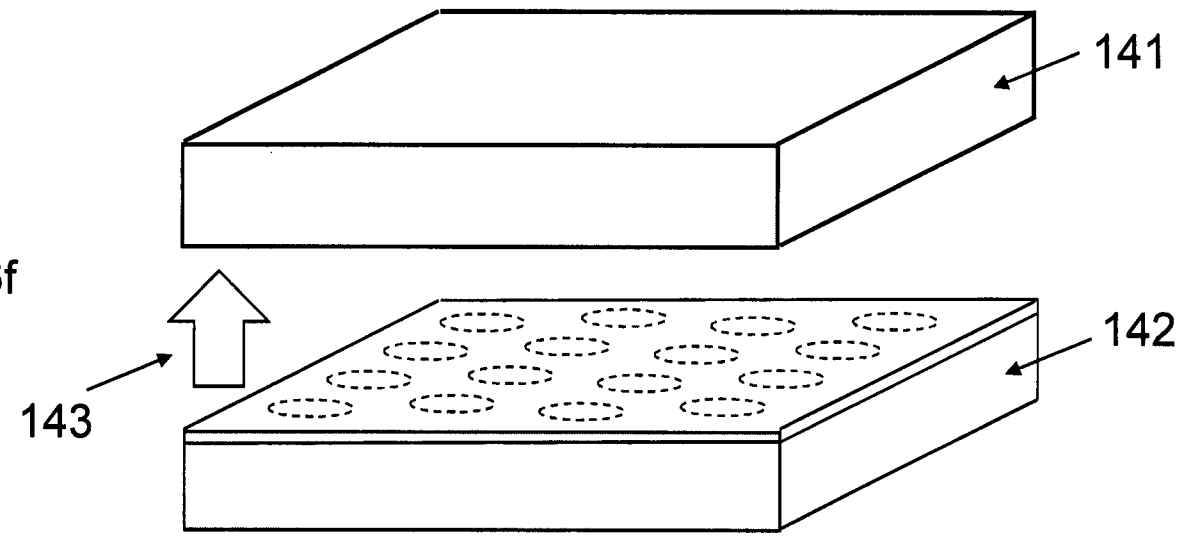
FIG. 6*f* shows the sequence of opening according to the embodiment of the invention in FIG. 6*e*.

FIG. 6*e* shows a 3 dimensional view of a disposable package 148 for medical use where the protection to the cover sheet is provided by a fully removable lid 141. In order to access the carrier 142, the lid 141 needs to be fully removed following the direction indicated by arrow 143 as shown in FIG. 6*f*.

Figure 6G:
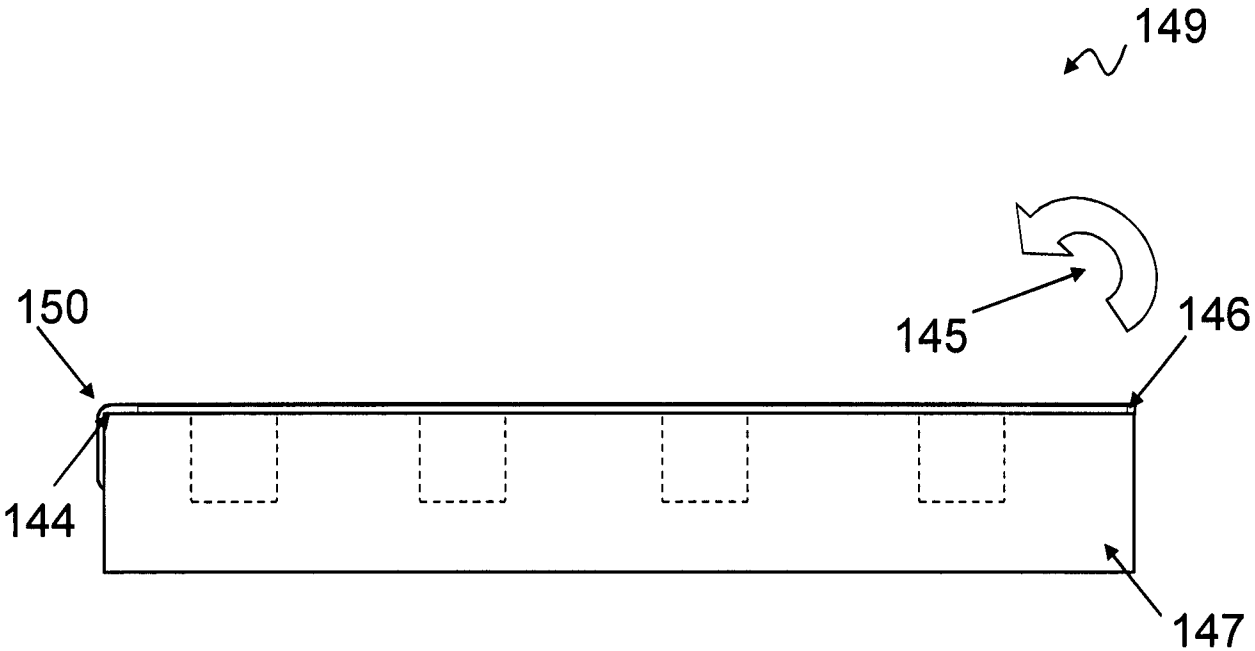
FIG. 6*g* shows a side view of a disposable package for medical use where the lid comprises an adhesive element.

FIG. 6*g* shows a side view of a disposable package 149 for medical use where the lid 146 is at least partially fasten to the cover sheet (not shown) or to the carrier 147. Access to the cover sheet (not shown) or to the carrier 147 may be achieved by opening the lid 146 following arrow 145 and through a rotation of the lid 146 along one of the edges 144 of the carrier 147. This is possible as the lid 146 had an adhesive element 150 which is fasten, e.g. by means of glue, along one of the edges 144 of the carrier 147.

An object of the invention is to provide a container for pharmaceutical compositions as a rigid structure.

For example in a single use medical package according to one aspect of the invention the carrier sheet further comprises at least two rims areas each at least partly surrounding a carrier half, the rims protruding in a direction perpendicular to said cover sheet and adapted to engage with each other, when said medical package is closed.

An outer foil may be attached to areas adjacent the rims at a surface of the carrier sheet being the outer surface of the package when the package is closed.

Figure 14A:
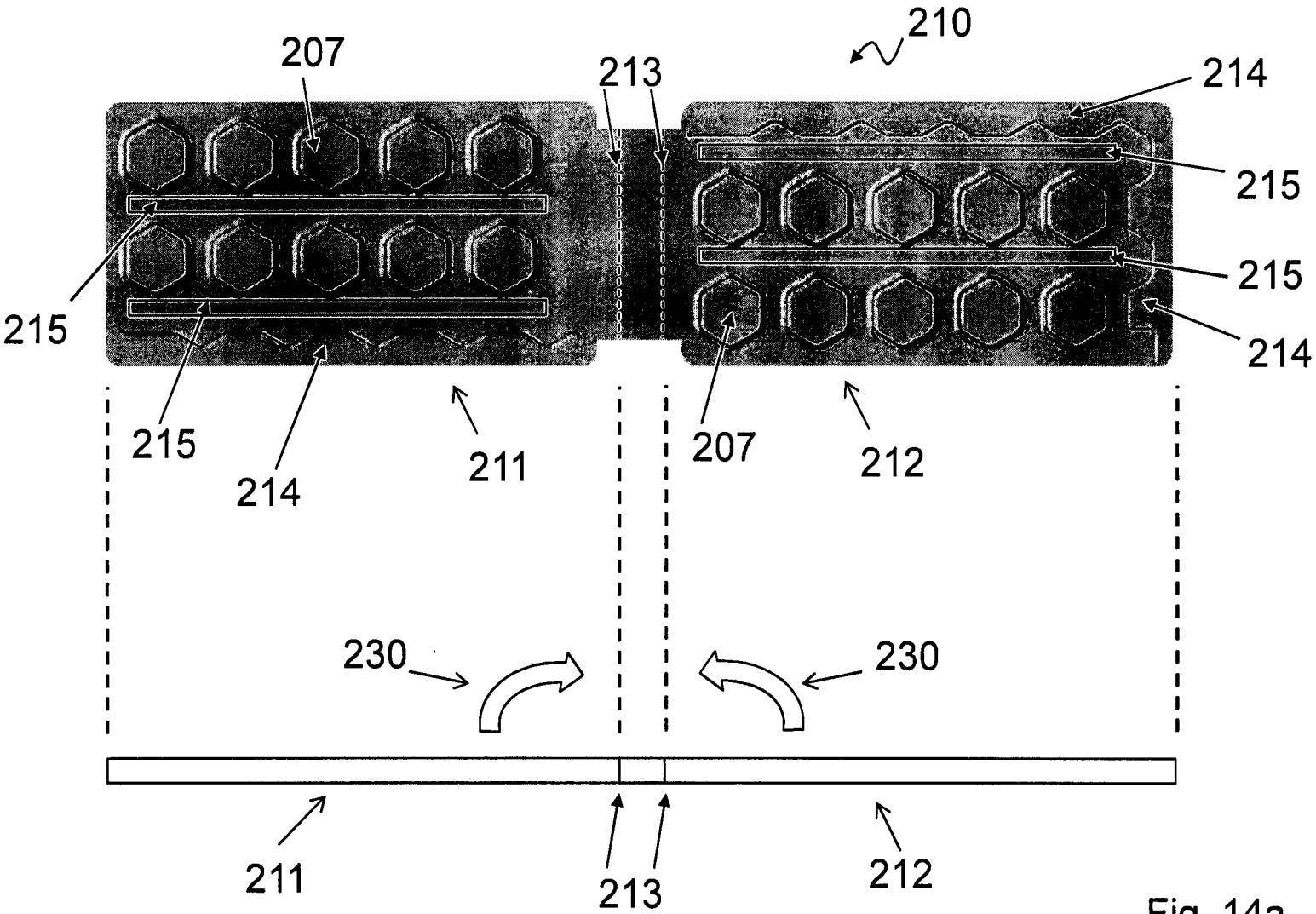
FIG. 14*a* shows schematically a top view of an embodiment of the invention where the carrier sheet is in an unfolded state.
Figure 14B:
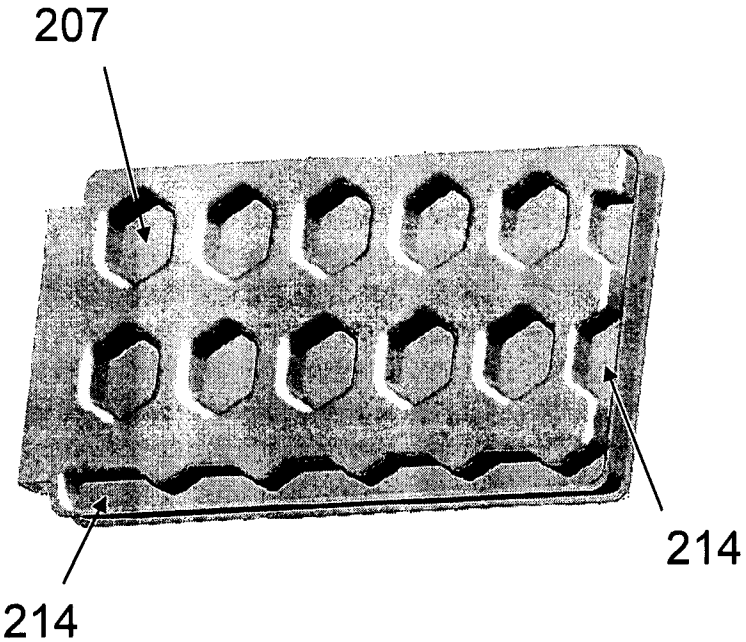
FIG. 14*b* shows schematically a 3-D view of the embodiment of the invention of FIG. 14*a* in its folded state.

This rigid structure can e.g. be obtained by a carrier 210 as shown in FIGS. 14*a* and 14*b*. The carrier 210 may be produced in a single foil in which two halves 211,212 each comprising cavities 207 arranged in rows may be identified. FIG. 14*a* and FIG. 14*b* show the carrier 210 in un-folded and folded state, respectively. The two halves 211,212 are adapted to be folded in such a way that the cavities 207 intermesh and thereby provide both stiffness and compactness to the carrier 210. The carrier 210 is preferably folded along two fold lines 213 so that the closed end of the cavities 207 lies on the opposite half, i.e. the closed end cavities 207 of half 211 lies on half 212 and vice versa, as shown in FIG. 14*a* following arrows 230. Such a design results in a carrier 210 where the pharmaceutical compositions are to be accessed from both sides of the carrier 210. The cavities 207 are covered by a cover sheet 208 as described above; preferably the same cover sheet covers both halves 211,212; it could also be that two separate cover sheets covers each half 211,212. The cover sheet 208 is preferably sealed to the carrier 210 before folding, but it can in principle also be attached after folding the carrier 210. In FIGS. 14*a* and 14*b*, the cavities 207 are honeycomb-shaped and arranged in two rows on each half 211, 212 of the carrier 210. This configuration provides extra rigidity to a flexible blister structure once folded. In general in the folded state, the closed bottom part of the cavities 207 of the half 212 may support a correspondent area on half 211 and vice versa. Any other shape of intermeshing cavities which in the folded state can support the carrier sheet and provide rigidity to the final structure may be envisaged.

Figure 20:
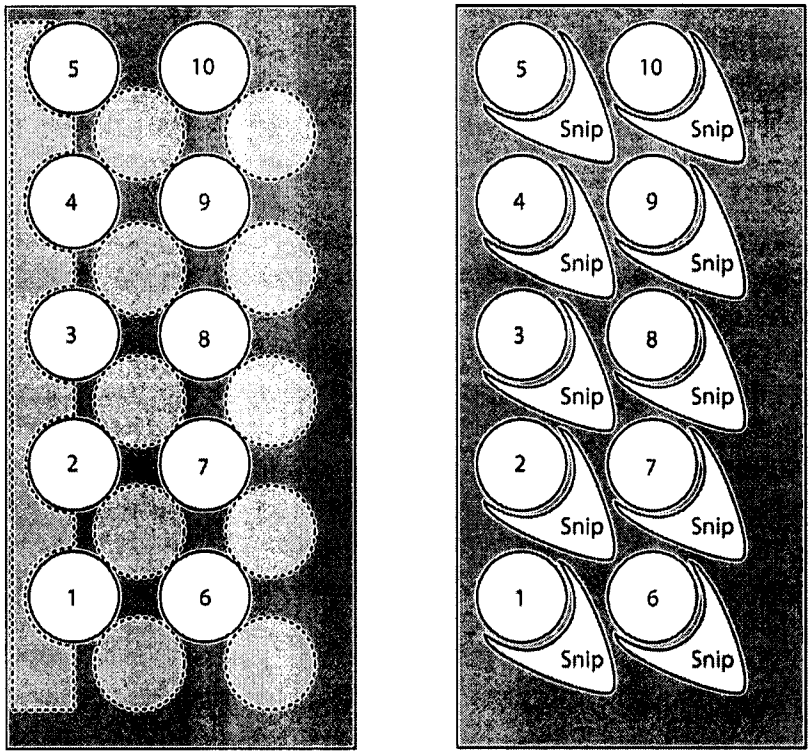
Figure 21:
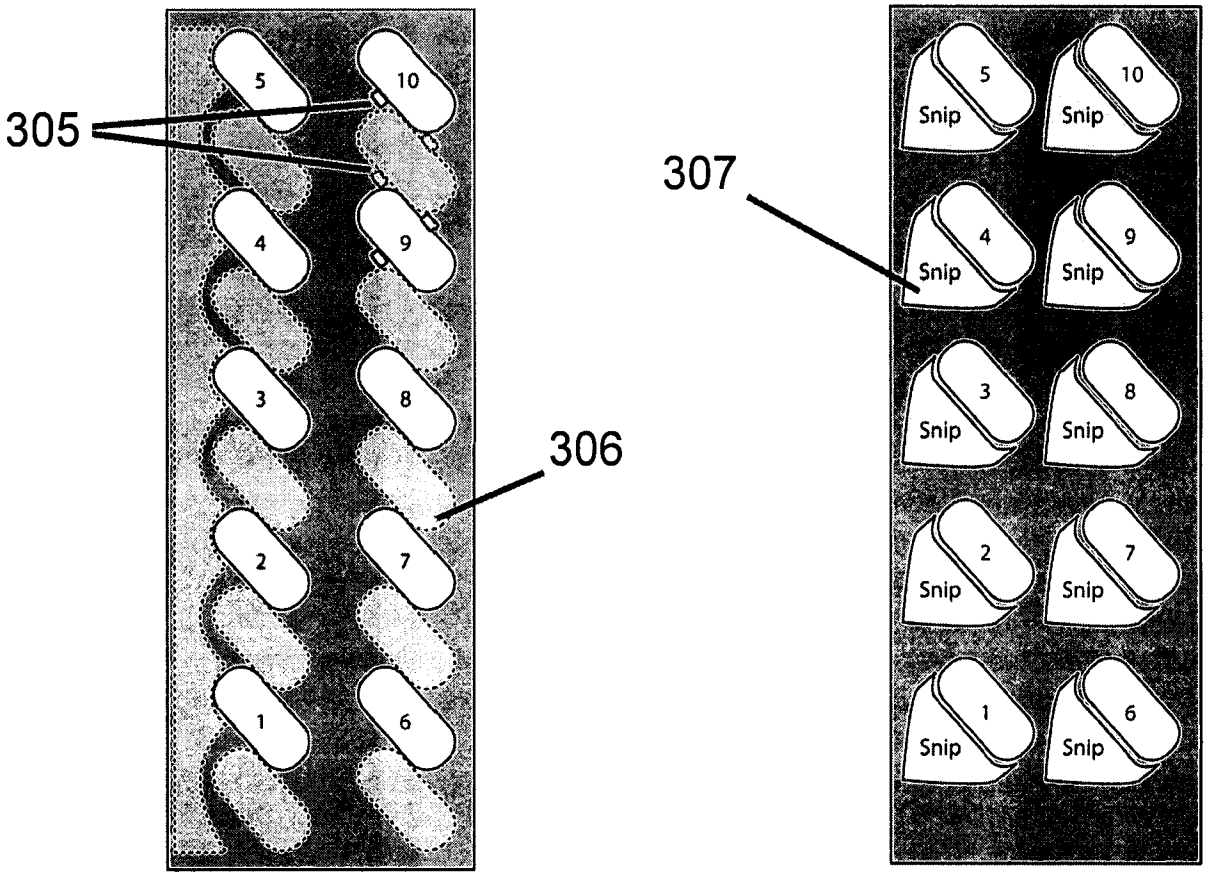

Furthermore cavities location on the surface of the carrier sheet can be optimized, e.g. by trial and error, so as to provide an optimal structure supporting the rigidity of the package. For example FIGS. 19-23 show examples of packages where the location of the cavities on the surface of the carrier sheet may provide an optimal structure to increase the rigidity of the package. For example in FIG. 19, the different location of the cavities, e.g. 301 and 302, may also be coupled to a different location and design of the snip, e.g. 304 for removing the cover sheet and providing access to the cavity underneath. 303 identifies the glued area connecting top and bottom surface of the carrier sheet carrying blisters, e.g. 301 and 302. FIGS. 20 and 21 show two embodiments of the medical package with cavities and snips having an alternative shape. In FIG. 21 small bulges are 305 present between cavities, e.g. 306 and snip, e.g. 307.

Figure 22:
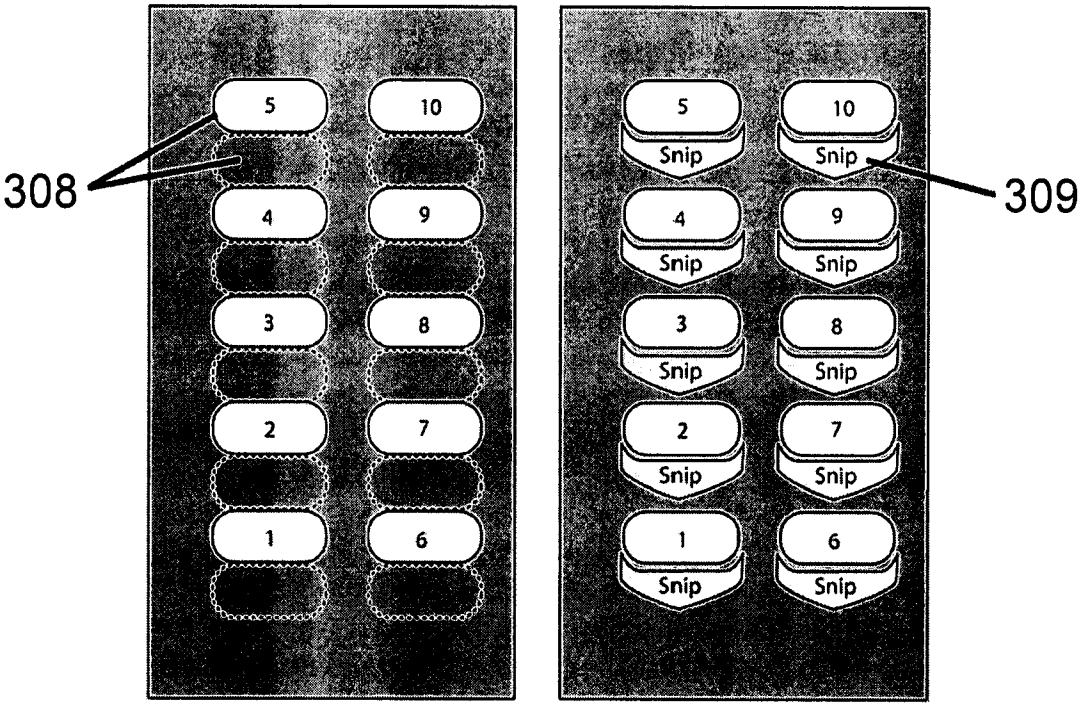
Figure 23:
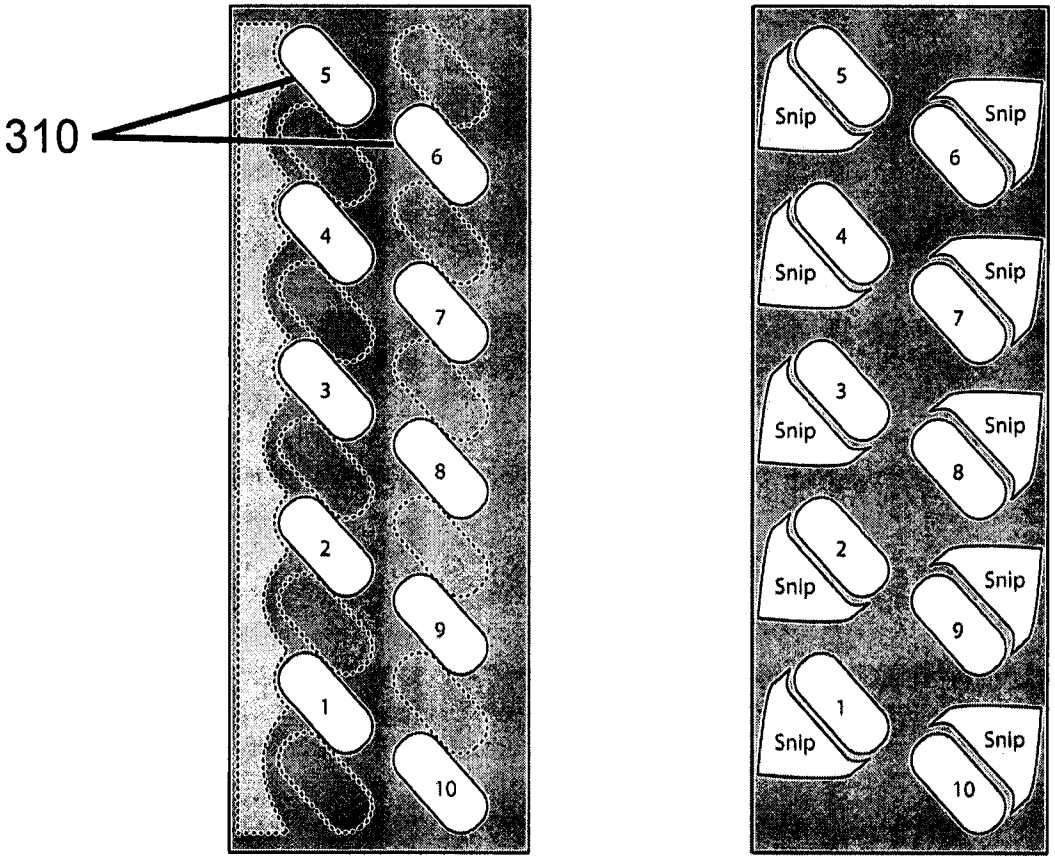

FIGS. 22 and 23 show further embodiments of the medical package with different combination of cavities, e.g. 308 or 310, and snips, e.g. 309, also providing more rigidity to the structure.

Rigidity and thereby protection of the pharmaceutical composition arranged in the cavities 207 is also provided by the edge parts 214 being formed to provide barriers and support for the carrier sheet along the edges of the carrier 210 when folded. Other shapes and arrangements fulfilling the same purpose are also covered by the scope of the present invention. The fact that the two halves 211,212 are made from one folded sheet of material instead of using two separate sheets means that they are kept in a more fixed mutual relationship which adds to the rigidity of the carrier 210. To prevent the carrier 210 from unfolding, the two halves 211, 212 of the carrier 210 can be joined e.g. by strings of adhesive 215, such as hot melt adhesive. Such joining will further prevent mutual movement of the two halves 211,212 and thereby also provide further rigidity to the carrier 210.

Figure 15A:
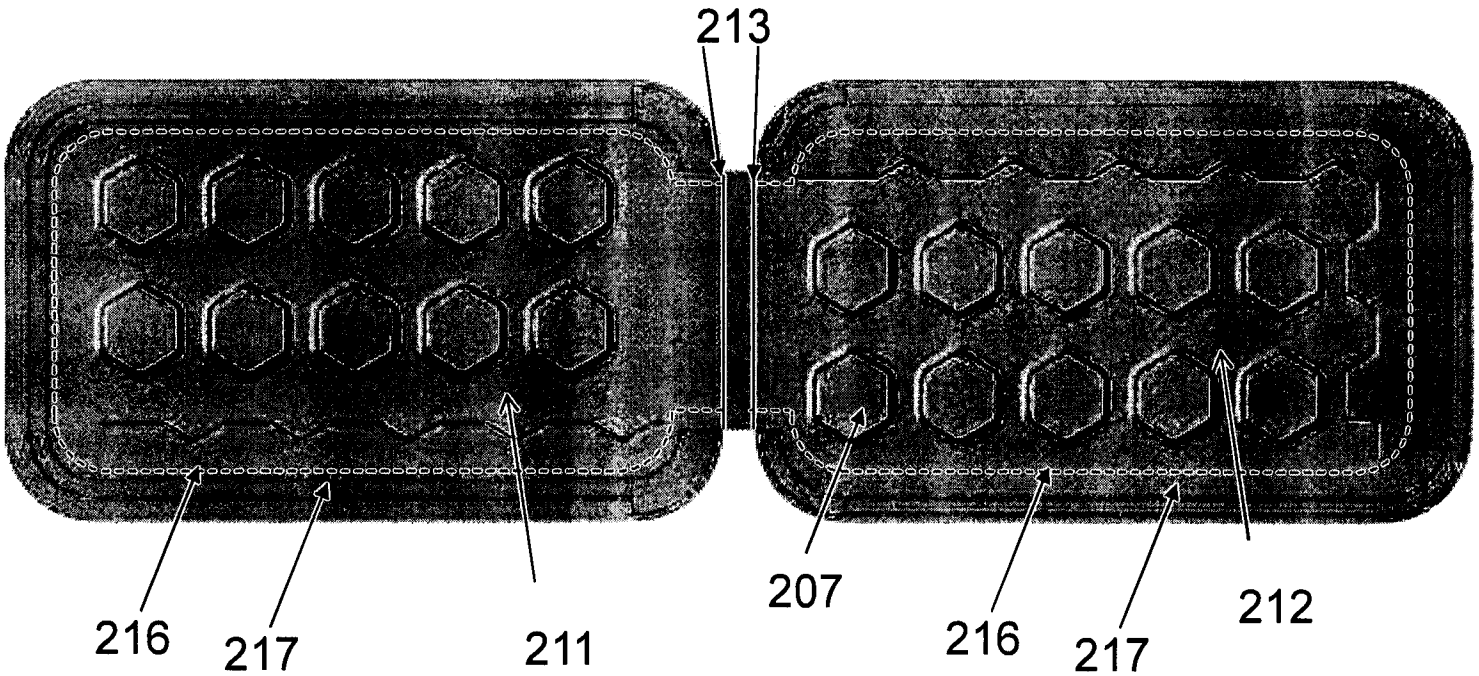
FIGS. 15*a,b,c,d* show an alternative embodiment based on the same principle of folding as in FIGS. 14*a* and 14*b*.
Figures 15B, 15D:
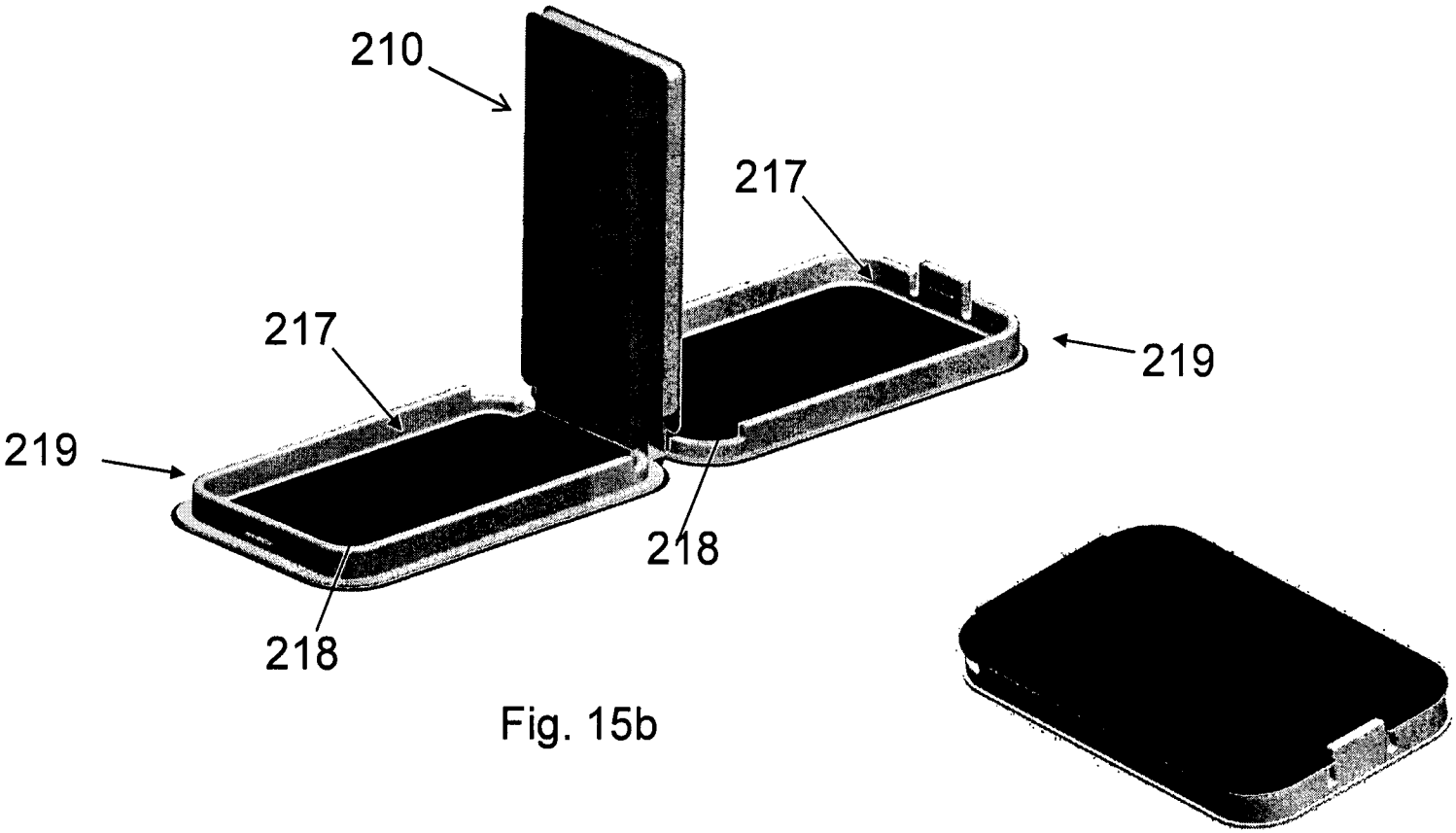
Figure 15C:
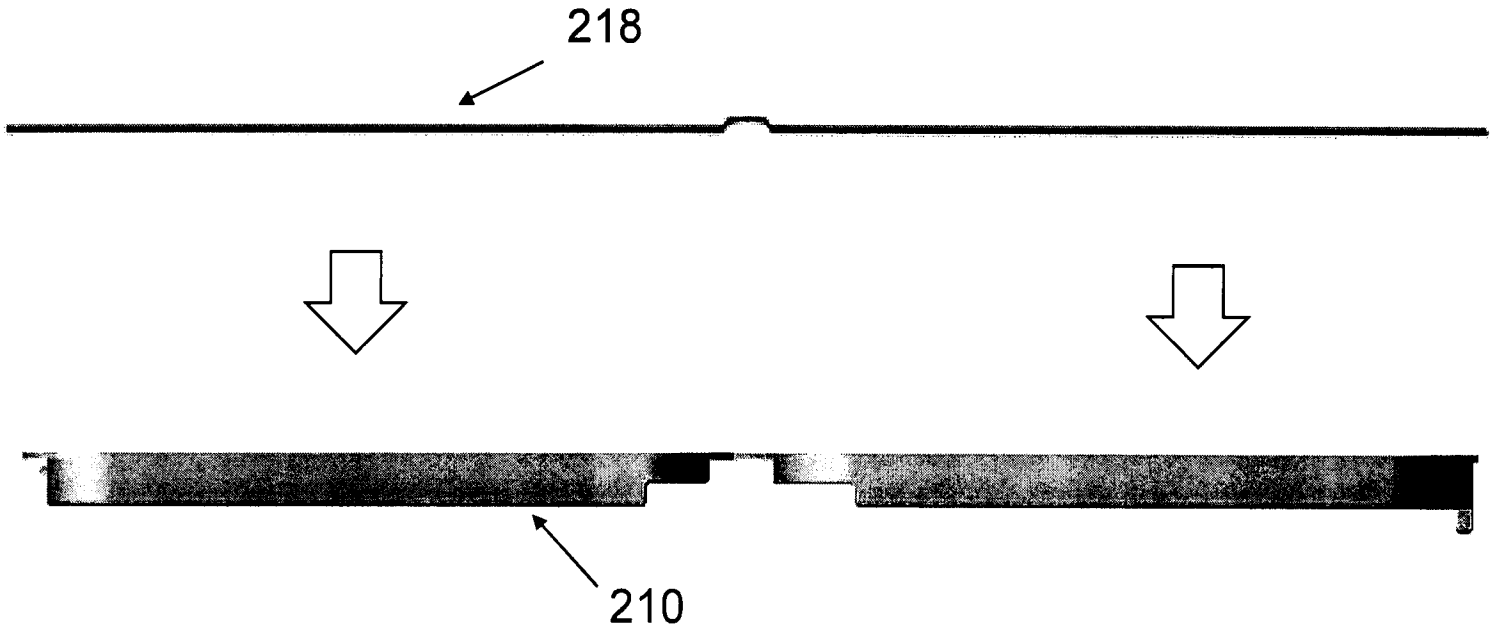
Figure 16A:
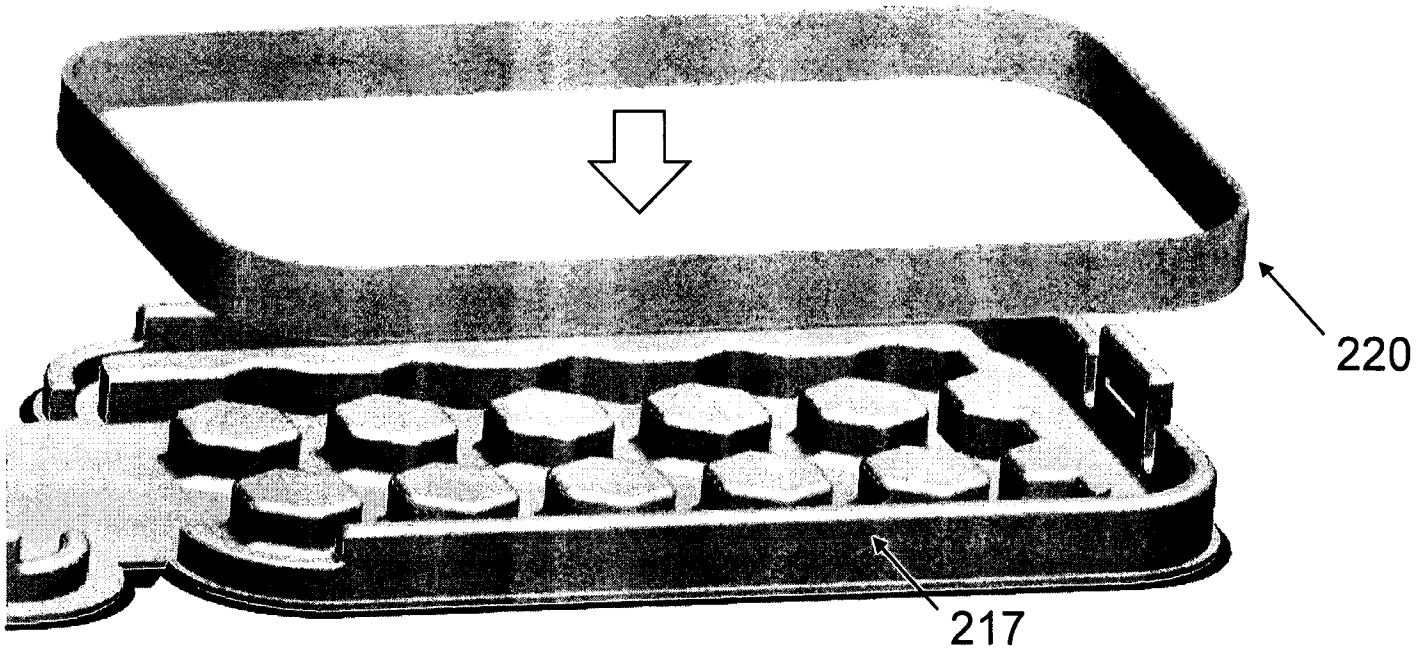
FIGS. 16*a* and 16*b* show schematically a 3-D view of the embodiment of the invention of FIG. 15*a,b,c,d* before and after fastening of a supporting ring respectively.
Figure 16B:
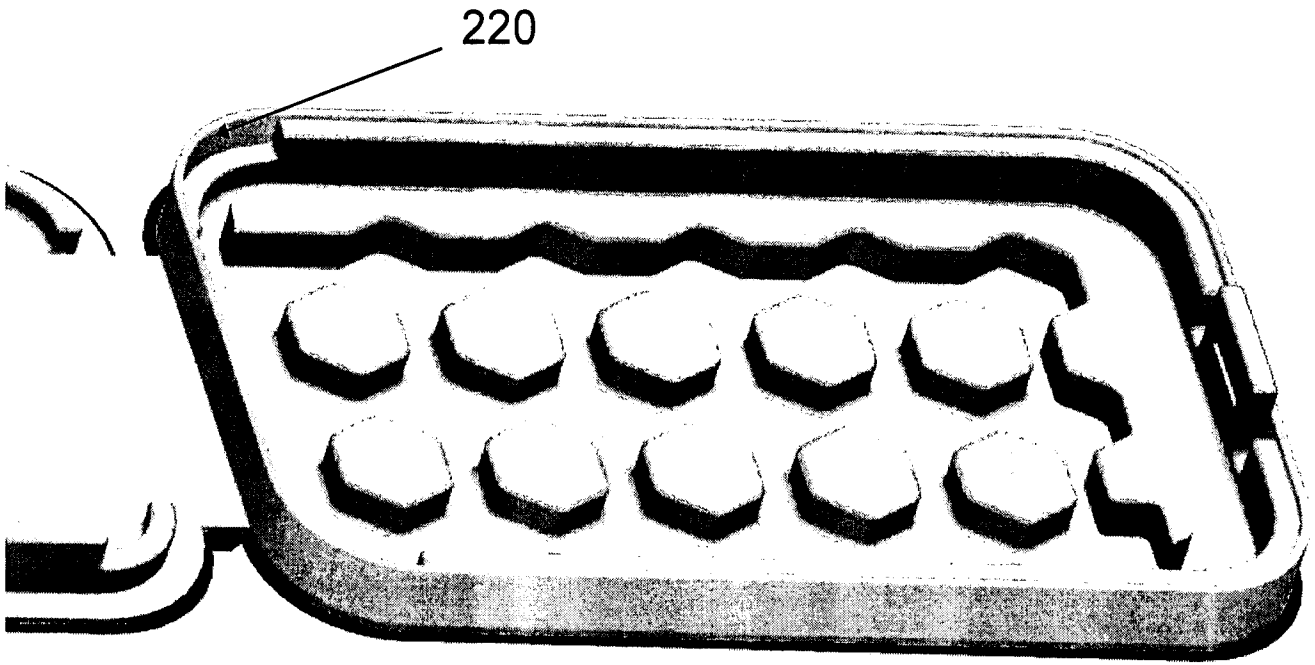

FIG. 15*a,b,c,d* show an alternative embodiment based on the same principle of folding as in FIGS. 14*a* and 14*b*. FIG. 15*a* shows the unfolded carrier 210, where the broken lines 216 show the shape of the carrier 210 in FIG. 14*a*. The embodiment in FIG. 15*a,b,c,d* is provided with protruding rims 217 along the edges. The sheet to become the carrier 210 and the rims 217 is typically shaped by thermoforming a plastic sheet. After thermoforming to the shape in FIG. 15*a*, the sheet is punched along the broken lines 216 around the two halves 211,212 comprising the cavities 207. The two halves 211,212 are folded following arrows 230 as shown in FIG. 14*a* so as to reach the folded structure as shown in FIG. 15*b* which would leave the spaces between the rims 217 as holes. To obtain closed outer surfaces of the container, an outer foil material 218, such as a plastic foil, is fastened to the rim areas 217, preferably before the folding. The joining of the outer foil 218 and the rim area 217, and thereby to the carrier 210, is shown in FIG. 15*c*, and the resulting look is seen from FIGS. 15*b* and 15*d* in opened and closed state, respectively. In this way, the carrier 210 and thereby the pharmaceutical compositions will be protected by the sections 219 comprising the rims 217 and the outer foil 218 which will function as lids. If further rigidity and an even more closed design are desired, this can be obtained by adding a further ring 220 on top of each rim 217. This is shown in FIGS. 16*a* and 16*b* before and after fastening of the ring, respectively. The ring 220 can be fastened by any suitable means, such as by adhesive or by press fit.

In one embodiment the carrier 210 including the rims 217, following the punching along the broken lines 216, the filling with a pharmaceutical composition and the further covering by foil 218 is folded without separating rims 217 and carrier 210. Upon opening of the blister package the foil 218 sealed to the rims 217 will act as lids and the package opens along the broken lines 216 which have been punched following the thermoforming process. In this way further rigidity of the structure is obtained as the breakage along lines 216 is only achieved after the first use of the package, so as to avoid undesired opening during transportation from the producer to the first user of the package.

A first step in a presently preferred manufacturing method for the embodiment in FIG. 15*a,b,c,d* would be to shape the sheet comprising the carriers 210 and the rims 217 to the geometry shown in FIG. 15*a*. This would typically be done by first thermoforming of a plastic sheet. The cavities 207 are then filled with the pharmaceutical compositions, and the cavities 207 are covered by a cover sheet 208, typically made from aluminium foil. The next step is punching where the carrier halves 211,212 are separated from the rim areas 217. In the same or in a subsequent punching step, flaps 201 can be made as previously described, e.g. in relation to FIG. 11*a,b*. Then the outer foil 218 is fastened to the rim areas 217 as shown in FIG. 15*c*. The outer foil 218 can be sealed and/or fastened e.g. by thermowelding or by gluing. The outer foil 218 can be a continuous foil providing further protection to the cover sheet 208, so that no access to the cover sheet 208 is possible unless outer foil 218 is removed following the opening of the package.

In some embodiments the outer foil 218 may either have the desired shape before fastening to the rim area 217, or it can be fastened as a sheet material covering a large number of containers so that it has to be punched to the desired shape after fastening.

All the steps described up to now can be performed without the need to turn the material which is advantageous from a manufacturing point of view. The following steps are preferably performed after rotating the containers by 180° so that what was before the underside becomes the top side. If desired, adhesive, such as strings of hot-melt adhesive is applied, and if desired, rings 220 of thermoformed plastic are arranged on top of the rims 217. The two halves 211,212 of the carrier 210 are then folded together and joined, and the "lids" comprising the rims 217 with the outer foil 218 are closed around the carrier 210. If desired, instructions for use of the pharmaceutical compositions can be arranged inside the container; it can e.g. be glued to the inner side of the outer foil 218 before the container is closed.

An alternative medical package having a build-in covering lid will be described in the following with reference to FIGS. 17*a,b,c* and 18*a,b*.

For example a single use medical package according to one aspect of the invention may comprises at least four sections arranged in a row and made from a single sheet, each section being pivotally connected to at least one of the other sections along a fold line in the single sheet.

As single sheet is meant a continuos sheet of, e.g. plastic.

Each of two middle sections of the at least four sections may constitute a carrier half containing at least one cavity for housing pharmaceutical compositions, the two carrier halves being pivotally connected to each other.

Each of the two end sections of the at least four sections constitutes an outer cover part for at least one of the carrier half, each of the two end sections being pivotally connected the correspondent carrier half.

Correspondent is herein defined as the complementary carrier half according to FIGS. 17 *a,b,c* and 18 *a* and 18*b*.

The at least four sections are adapted to be folded into a folded configuration where the two carrier halves are located adjacent to each other with the cavities intermeshing and with the open sides of the cavities facing away from each other.

In this way each of the two outer cover parts is located adjacent a carrier half.

Figures 17A, 17B:
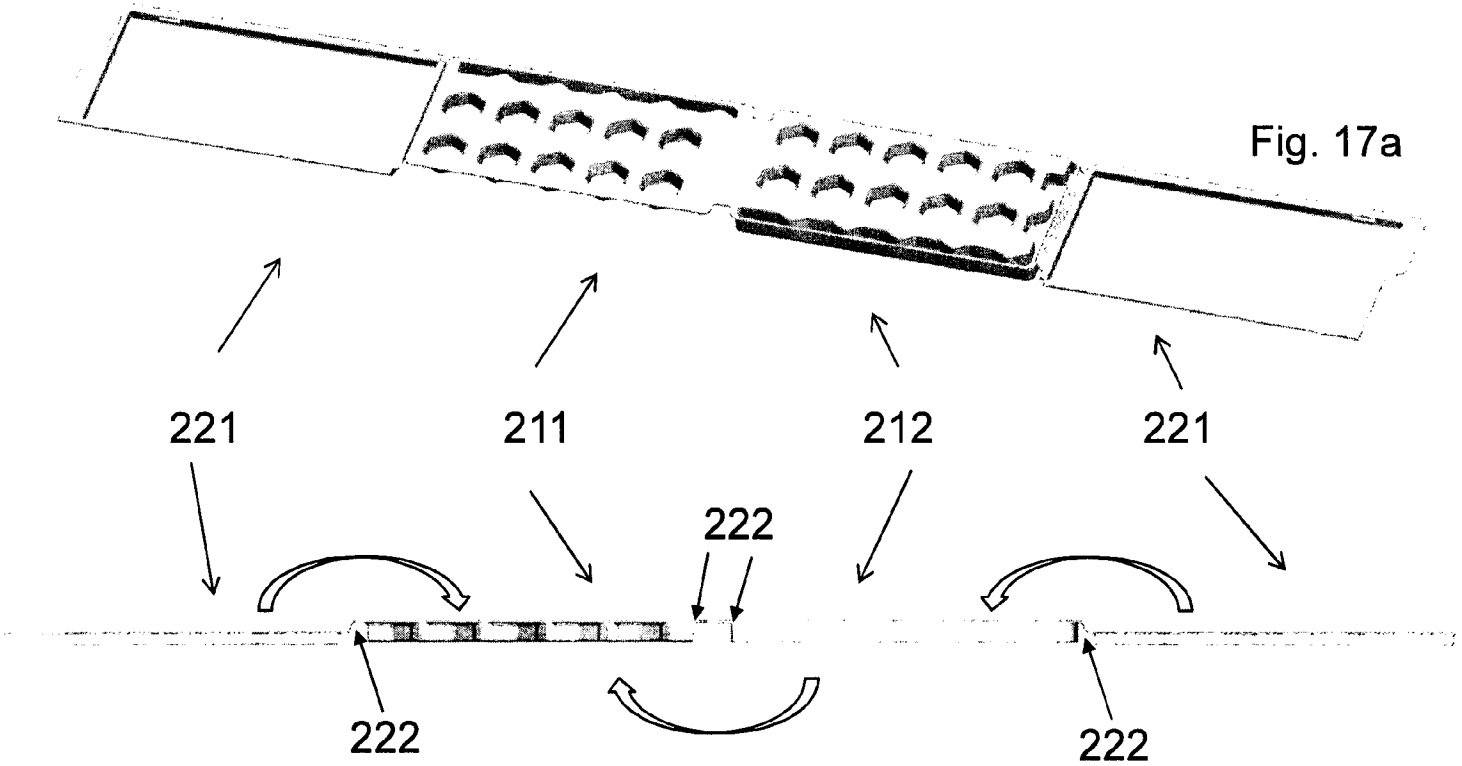
FIG. 17*a, b, c
Figure 17C:
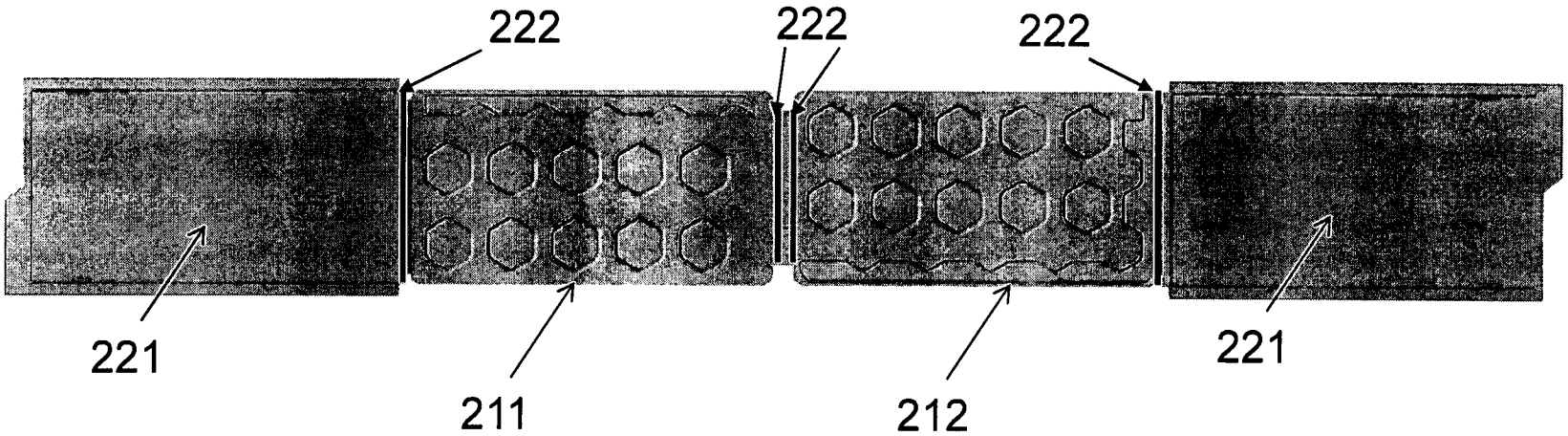
Figure 18B:
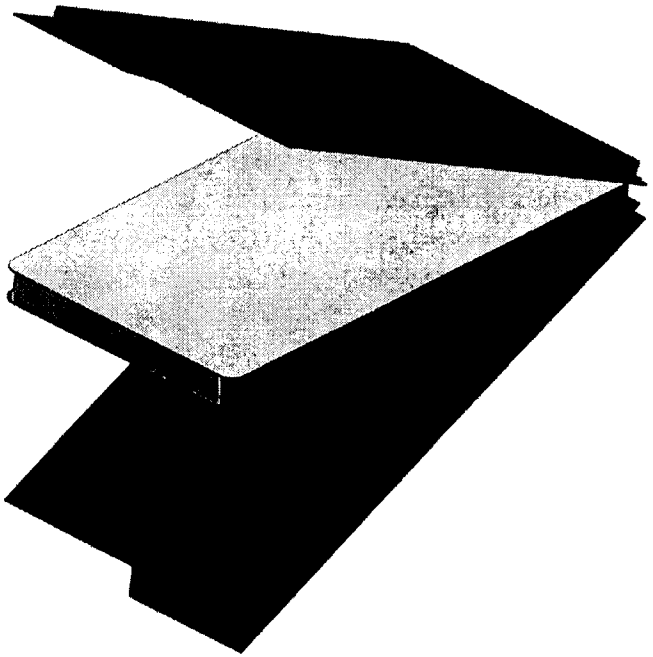
* and FIGS. 18*a* and 18*b* show schematically a top view and 3-D view of an embodiment of the invention having a build-in covering lid.
Figure 18A:
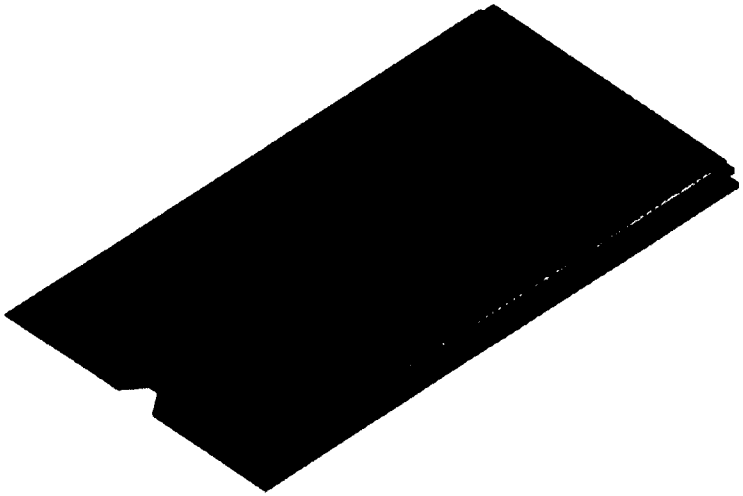
Figure 19:
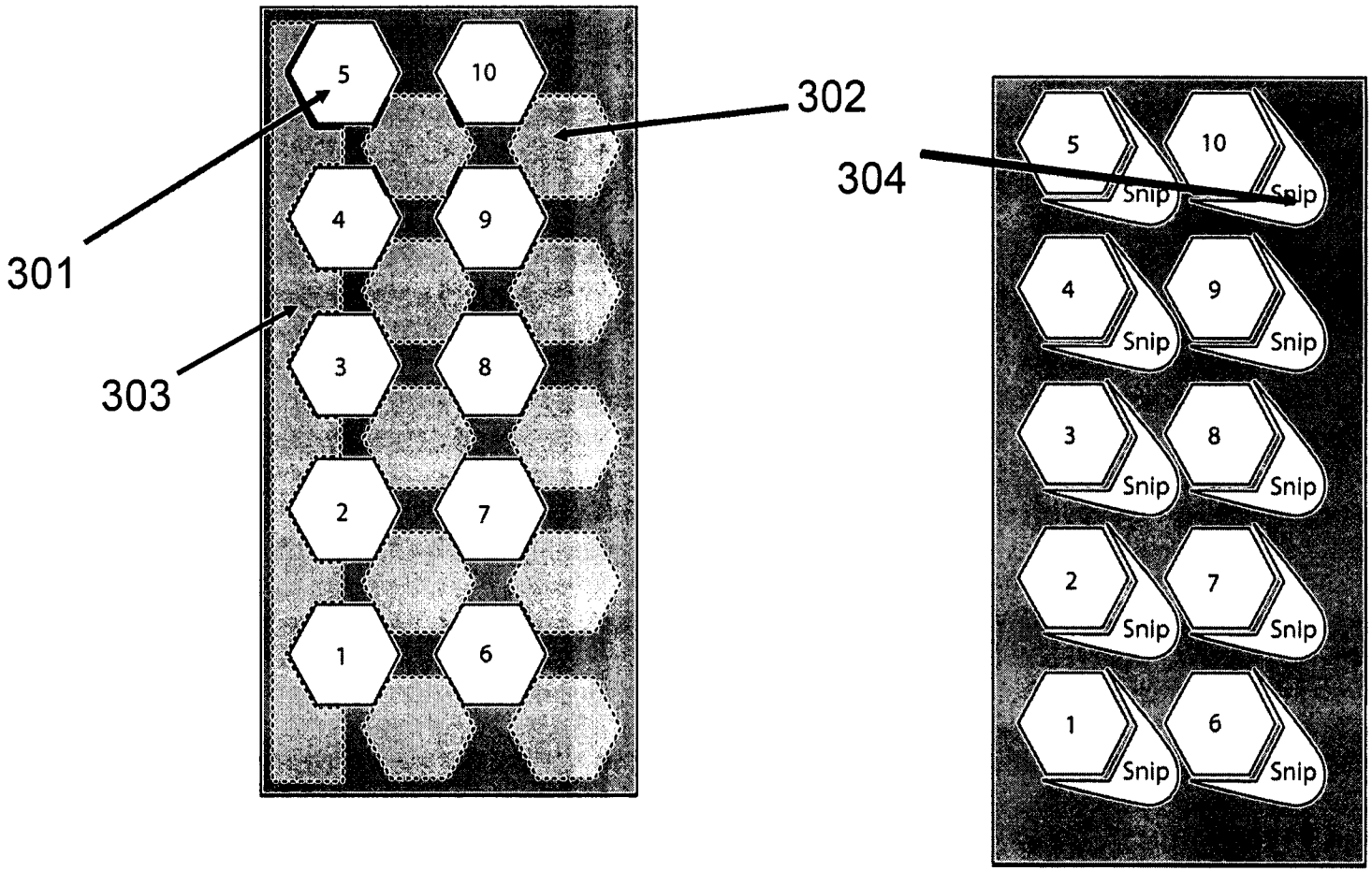
FIGS. 19-23 show examples of packages where the location of the cavities on the surface of the carrier sheet may provide an optimal structure to increase the rigidity of the package.

The design is based on the first step being thermoforming a plastic sheet to the shape shown in FIG. 17*a*. The sheet comprises a carrier sheet comprising two carrier halves 211, 212 corresponding to the ones in FIG. 14*a*. The sheet further comprises at the two distal ends of the carrier halves 211,212 two outer cover parts 221. These parts 221 are an extension of the carrier halves where the thermoforming has been performed so as to produce rims but not cavities for holding pharmaceutical compositions. It may be seen as an advantage that a single foil of plastic material may be thermoformed so as to identify parts having different functions, e.g. for carrying pharmaceutical composition or for providing further protection to the cover sheet protecting the cavities, without having to change its orientation. The plastic sheet is then folded into a container as shown schematically in the side view in FIG. 17*b* by folding along the fold lines 222 shown in FIG. 17*c*. In its folded state the blister package shows only the two cover part 221 as shown in FIG. 18*a*. When ready for use, it is possible to gain access to one side of the carrier 210 only by opening one of the outer cover parts 221 (not shown). FIG. 18*b* shows the container in a state where both outer cover parts 221 are partly opened. An advantage of this embodiment is that the carriers 210 and the outer cover parts 221 are made from the same sheet of material and no further covering is needed except for the cover sheets for covering the pharmaceutical compositions in the cavities 207.

In some embodiments a medical package with a larger capacity can be obtained by arranging more than two carrier halves in a row, which halves are then folded together and preferably joined by adhesive two-by-two. A double, triple or multiple structure can therefore be achieved where each two carrier halves may be joined two-by-two. In this configuration the two distal ends, i.e. the outer covers provide cover for the most external carrier halves.

A multiple structure may provide better rigidity to the package and increase the volume of cavities available for carrying pharmaceutical compositions, in turn increasing the amount of pharmaceutical compositions which can be carried by the medical package at the price of a limited increase of package thickness.

A further advantage of the medical package of the invention is that due to the rigid structure, provided, e.g. by the flat hard cover and shape of the package, the invention may provide a easy to stack container, where flat hard covers can be stacked against each other into stabile stack for storage on shelves; reducing the need of shelf space in relation to the amount of pharmaceutical compositions stored.

Although the present invention has been described in connection with the specified embodiments, it should not be construed as being in any way limited to the presented examples. For example the carrier has been described as being made by thermoforming a plastic sheet. However, other manufacturing processes, such as thermoplastic moulding, are also covered by the scope of the present invention. The materials may also differ so that parts of the containers can be made e.g. polymer foam, composite materials or from paper-based materials, such as cardboard. Correspondingly, other joining methods than the ones mentioned are covered; such methods will be well known to a person skilled in the art. Any of the embodiments could be provided with closing and opening means as shown in the figures. Other possible designs of closing and opening means will lie within the person skilled in the art.

The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A single use medical package comprising:

a carrier with at least two cavities for housing pharmaceutical compositions on at least one of the carrier surfaces and at least one cover sheet, wherein said carrier comprises a rigid structure, wherein said rigid structure is or comprises an internal hollow structure; wherein said internal hollow structure is at least partially hollow between the top and the bottom surface of said carrier, wherein said carrier has at least one cavity for housing pharmaceutical compositions on the top and at least one cavity for housing pharmaceutical compositions on the bottom surface of said carrier;

wherein said carrier comprises at least two pivotally connected halves each comprising at least one cavity for housing pharmaceutical compositions, and wherein said at least two halves are made from one single sheet foldable into a folded configuration thereby producing said rigid structure; wherein the at least one cavity on one of said at least two halves of said carrier is located off-set with respect to the at least one cavity on the other of said at least two halves so that the cavities intermesh when the two halves are folded into said folded configuration;

wherein said carrier further comprises at least two rim areas each at least partly surrounding a carrier half, the rims protruding in a direction perpendicular to said cover sheet and adapted to engage with each other, when said medical package is closed, further comprising a fully or partly punched line through said one single sheet of plastic material at locations around the two halves comprising cavities where said carrier halves are to be separated from said rims areas.

2. The single use medical package according to claim 1, comprising at least four sections arranged in a row and made from a single sheet, each section being pivotally connected to at least one of the other sections along a fold line in said single sheet.

3. The single use medical package according to claim 2, wherein each of two middle sections of said at least four sections constitutes a carrier half containing at least one cavity for housing pharmaceutical compositions, the two carrier halves being pivotally connected to each other.

4. The single use medical package according to claim 3, wherein each of the two end sections of said at least four sections constitutes an outer cover part for at least one of said carrier half, each of the two end sections being pivotally connected to the correspondent carrier half.

5. The single use medical package according to claim 2, wherein said at least four sections are adapted to be folded into a folded configuration where said two carrier halves are located adjacent to each other with said cavities intermeshing and with the open sides of said cavities facing away from each other.

6. The single use medical package according to claim 1, wherein an outer foil is attached to areas adjacent said rims at a surface of said carrier sheet being the outer surface of the package when the package is closed.

7. The single use medical package according to claim 1, wherein the access to said at least one cavity is achieved by removal of said at least one cover sheet.

8. The single use medical package according to claim 1, wherein the removal of said at least one cover sheet is achieved by peeling off said at least one cover sheet.

9. The single use medical package according to claim 1, wherein said at least one cover sheet is protected by at least one lid.

10. The single use medical package according to claim 9, wherein at least one lid is opened through a rotation of said lid along at least one rotational joint located on the carrier.

11. The single use medical package according to claim 9, wherein said at least one lid is or comprises at least one adhesive element.

12. The single use medical package according to claim 9, wherein said at least one lid contains a leaflet with information of interest to the user.

13. The single use medical package according to claim 1, comprising at least two cover sheets wherein said carrier has at least two cavities for housing pharmaceutical compositions, said at least two cover sheets are at least partially sealed to the carrier around said at least two cavities for housing pharmaceutical compositions, and said at least two cover sheets overlap and delimit at least one element characterized in that the access to said at least one element is gained by removal of the precedent overlapping cover sheet and that the access to further elements is gained by sequential removal of the respectively precedent overlapping cover sheets.

14. A method of manufacturing a medical package according to claim 1, the method comprising:

processing a sheet of plastic material, filling the cavities with pharmaceutical compositions, attaching at least one cover sheet to said carrier halves so that the open sides of the cavities are sealingly covered by said at least one cover sheet, folding said carrier halves together so that said cavities intermesh, and folding said outer cover parts to adjacent said carrier halves.

15. The method of manufacturing a medical package according to claim 14, wherein said folding of said carrier halves comprises:

folding said carrier halves by 180° into an overlapping configuration so that said carrier halves lie on top of each other.

16. The method of manufacturing a medical package according to claim 14, wherein said folding of said outer cover parts comprises:

folding said outer cover parts by 180° into an overlapping configuration onto said carrier halves so that each outer cover part overlaps the carrier half to which is pivotally connected to.

17. A method of manufacturing a medical package according to claim 1, the method comprising:

processing a sheet of a plastic material, filling the cavities with pharmaceutical compositions, attaching at least one cover sheet to said carrier halves so that the open sides of the cavities are sealingly covered by said at least one cover sheet, punching fully or partly through the sheet of plastic material at locations around the two halves comprising cavities where said carrier halves are to be separated from said rims areas, attaching the outer foil to said rims areas folding said carrier halves together so that said cavities intermesh, and joining said carrier halves.

18. The method according to claim 17, wherein said folding of said carrier halves comprises:

folding, before separating said carrier halves from said rim areas, said carrier halves and said rim areas by 180° into an overlapping configuration so that said carrier halves lie on top of each other.

19. The method according to claim 17, wherein said folding of said carrier halves comprises:

folding, after separating said carrier halves from said rim areas, said carrier halves by 180° into an overlapping configuration so that said carrier halves lie on top of each other.

20. The method according to claim 17, wherein said punching is fully through said sheet of the plastic material allowing for folding of said carrier halves by 180° into an overlapping configuration so that said carrier halves lie on top of each other, while said rims areas remains unfolded in the same plane.

* * * * *